US012281874B2

(12) United States Patent
Paulson et al.

(10) Patent No.: US 12,281,874 B2
(45) Date of Patent: Apr. 22, 2025

(54) SAFING SECTOR ASSEMBLY FOR A ROTARY MACHINE GUN

(71) Applicant: DTV Arms, LLC, Hendersonville, TN (US)

(72) Inventors: Kristopher Lee Paulson, Hendersonville, TN (US); Matthew Steinhauser, Philadelphia, PA (US)

(73) Assignee: CHD Holdings, LLC, Nashville, TN (US)

( * ) Notice: Subject to any disclaimer, the term of this patent is extended or adjusted under 35 U.S.C. 154(b) by 92 days.

(21) Appl. No.: 18/131,457

(22) Filed: Apr. 6, 2023

(65) Prior Publication Data

US 2024/0240913 A1 Jul. 18, 2024

Related U.S. Application Data

(60) Provisional application No. 63/438,879, filed on Jan. 13, 2023.

(51) Int. Cl.
*F41F 1/10* (2006.01)

(52) U.S. Cl.
CPC ..... *F41F 1/10* (2013.01)

(58) Field of Classification Search
CPC ..... F41F 1/10; F41A 7/08; F41A 9/36; F41A 3/26
See application file for complete search history.

(56) References Cited

U.S. PATENT DOCUMENTS

| | | | | |
|---|---|---|---|---|
| 3,380,341 | A * | 4/1968 | Chiabrandy | F41F 1/10 89/12 |
| 3,766,821 | A * | 10/1973 | Cozzy | F41F 1/10 89/149 |
| 7,013,789 | B2 * | 3/2006 | Dillon | F41F 1/10 89/12 |
| 7,703,374 | B1 | 4/2010 | Dillon | |
| 7,971,515 | B2 * | 7/2011 | Garwood | F41A 9/36 89/12 |
| 10,816,294 | B2 * | 10/2020 | Todd, II | F41F 1/10 |
| 11,248,873 | B2 | 2/2022 | Schira | |
| 11,441,864 | B1 * | 9/2022 | Garwood | F41A 35/00 |
| 2005/0115393 | A1 * | 6/2005 | Dillon | F41A 17/00 89/12 |

(Continued)

FOREIGN PATENT DOCUMENTS

WO WO-2019200150 A1 * 10/2019 ..... F41A 19/18

*Primary Examiner* — Jonathan C Weber
(74) *Attorney, Agent, or Firm* — Eric B. Fugett; Mark A. Pitchford; Pitchford Fugett, PLLC

(57) ABSTRACT

A safing sector assembly includes a safing sector frame securable to a minigun main housing, a top cover hingedly attached to the frame, and a safing gate hingedly attached to the top cover. The frame includes an aft camming portion of an elliptical cam track of the minigun on an underside thereof. The top cover is rotatable, while the frame is secured to the main housing, between a closed position and an open position. The safing gate includes a forward camming portion of the elliptical cam track on an underside thereof and is rotatable between an armed position and a safe position. The safing gate is only rotatable to the armed position while the top cover is closed. The safing gate latches the top cover closed, so the top cover can only be opened while the safing gate is in the safe position.

23 Claims, 17 Drawing Sheets

(56) References Cited

U.S. PATENT DOCUMENTS

| | | | | |
|---|---|---|---|---|
| 2020/0263945 | A1* | 8/2020 | Todd, II | F41A 17/32 |
| 2021/0116206 | A1* | 4/2021 | Schira | F41A 19/18 |
| 2021/0131757 | A1* | 5/2021 | Todd, II | F41F 1/10 |

* cited by examiner

SAFING SECTOR ASSEMBLY FOR A ROTARY MACHINE GUN

CROSS-REFERENCES TO RELATED APPLICATIONS

This non-provisional patent application claims priority to U.S. Provisional Patent Application Ser. No. 63/438,879, filed Jan. 13, 2023 and titled "SAFING SECTOR ASSEMBLY FOR A ROTARY MACHINE GUN," the entire disclosure of which is hereby incorporated by reference.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable.

REFERENCE TO SEQUENCE LISTING OR COMPUTER PROGRAM LISTING APPENDIX

Not Applicable.

BACKGROUND OF THE INVENTION

The present invention relates generally to the field of firearms, and more particularly, to safing mechanisms for rotary machine guns.

A rotary machine gun is an externally powered weapon system consisting of multiple barrels arranged to rotate about the central longitudinal axis of a rotor while discharging ammunition at a high rate of fire. An example is the M134 minigun, a six-barreled, electrically driven rotary machine gun with an external battery pack (hereafter referred to interchangeably as "minigun" or "machine gun"). A minigun utilizes a main housing enclosing and supporting a main rotary body known as a rotor assembly. The rotor assembly defines the central longitudinal axis of the minigun and is rotated by means of a series of gears driven by an electric motor. Cartridges are handled within the main housing by bolt assemblies, each of which includes a roller bearing thereon. The minigun typically includes six bolt assemblies, one associated with each of the six barrels. The bolt assemblies are attached to and radially surround the rotor assembly such that the bolt assemblies extend longitudinally along the rotor parallel to the central axis. The six barrels are attached to a forward portion of the rotor assembly and are arranged for rotation as a cluster around the central axis. An elliptical cam track is incorporated within the main housing. The cam track is angled diagonally between the front and rear of the main housing. The roller bearing of each bolt assembly is disposed within the elliptical cam track and arranged for rotation around the cam track by the rotor assembly. As the rotor rotates, the diagonal orientation of the cam track translates the rotational movement of the roller bearings into longitudinal movement of the bolt assemblies. This drives the bolt assemblies forward and rearward within the main housing, which, in turn, causes cartridges to be delivered to the bolt assemblies, chambered, fired, extracted, and ejected. More specifically, during operation the bolt assemblies each receive a cartridge as they move forward, fire the cartridge at their forwardmost position along the cam track, and eject the spent casing as they move rearward.

Miniguns also typically include a safety mechanism known as a "top cover and safing sector" assembly attached to the exterior of the main housing. As disclosed in U.S. Pat. No. 7,703,374, the entirety of which is hereby incorporated herein by this reference, the top cover can open like a hatch to allow an operator to access the inner workings of the minigun, such as the bolt assemblies, through an access port defined in the main housing of the machine gun, while the safing sector forms a removable portion of the elliptical cam track used to drive the bolt assemblies forward and rearward during operation of the minigun. Only two substantially different top cover and safing sector designs are known.

The original minigun design built by the General Electric Company in the 1960s includes a top cover attached to the safing sector by a pin which allows the top cover to pivot forward on the machine gun independently of the safing sector. The pivot feature between the top cover and the safing sector allows the top cover to be opened and closed independently of the safing sector. After, and only after, the top cover has been opened, the safing sector can be either partially or completely removed from the minigun. The purpose of partially removing the safing sector is to dislocate a critical forward camming section of the elliptical cam track that causes the bolt assemblies to move to their forwardmost position along the cam track and fire the cartridges. After the safing sector has been partially or completely removed, the minigun cannot be fired, hence the term "safing sector." Disabling the minigun so that it cannot fire is known as "safing" the gun. A minigun from which the safing sector has been partially or completely removed is known as having been "made safe" or simply "safed."

Deficiencies of this original top cover and safing sector design are detailed in U.S. Pat. No. 7,703,374. These generally include that the top cover must be opened before the safing sector can be removed to safe the minigun, which is time consuming and inconvenient. This also means that the top cover can be open, and the bolt assemblies therefore exposed, while the minigun is armed, loaded, and capable of firing, which is unsafe. Moreover, rearming a safed minigun necessarily requires replacing the safing sector, and thus the critical forward camming section of the elliptical cam track, before the top cover can be closed. This can cause an unintended discharge while the top cover is open if the safing sector moves an inopportunely positioned bolt assembly forward during replacement. The design of the safing sector also precludes electric rotation of the barrels while the minigun is safed because the aft camming section of the elliptical cam track which drives the bolt assemblies rearward is on the safing sector and is necessarily removed therewith during safing of the gun. This undesirably obligates the operator to manually rotate the barrels, which may be hot due to recent use, in order to remove any remaining live cartridges from the rotor assembly during malfunctions. Moreover, accidentally triggering electric rotation of the barrels while the minigun is safed risks damaging the bolt assemblies and rendering the weapon inoperable.

U.S. Pat. No. 7,703,374 also discloses a newer minigun safing mechanism in the form of a top cover and safing blade assembly. This design combines the top cover and the aft camming section of the cam track from the original 1960s design discussed above into a one-piece top cover unit with a separate single-step safety component (i.e., the "safing blade"). The forward camming section of the cam track responsible for driving the bolt assemblies forward to fire cartridges is incorporated into the safing blade, which is hingedly attached to the top cover and rotatable independently thereof. The safing blade is designed to pivot radially outward and away from the central axis of the rotor assembly at an angle normal thereto during safing the minigun. Pivoting the safing blade in this way removes the forward camming section from the cam track, thereby preventing the gun from firing. This allows the safing blade, and thus the critical forward camming section of the cam track, to be removed from the cam track separately from the aft camming section responsible for rearward motion of the bolt assemblies. This in turn enables an operator to safe the minigun without first opening the top cover, and to electrically rotate the barrels after the minigun has been made safe without damaging the bolt assemblies.

Though generally considered an improvement over the original top cover and safing sector of the 1960s, this design renders the bolt assemblies inaccessible while the top cover unit is attached to the main housing because the top cover cannot be opened independently of the safing blade. Removal of the top cover unit from the main housing requires detaching the entire assembly, including the aft camming section from the elliptical cam track, from the minigun. Without the aft camming section, the barrels cannot be electrically rotated. Consequently, this design forces an operator attempting to resolve an unknown malfunction to choose between being able to either (i) electrically rotate the barrels without simultaneously seeing or having access to the bolt assemblies, or (ii) seeing and accessing the bolt assemblies without electrical barrel rotation. An operator who makes the wrong choice is obligated to try the other, which is time consuming and inconvenient. Moreover, because viewing the bolt assemblies while electrically rotating the barrels is not possible with this design, more troublesome malfunctions the resolution of which require removal of live rounds as well as bolt assembly access (e.g., replacement of a damaged bolt assembly) can dangerously delay restoration of the machine gun to combat readiness.

Accordingly, there remains a need for improvements in rotary machine gun safing mechanisms and methods.

BRIEF SUMMARY

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Features of the presently disclosed invention overcome or minimize some or all of the identified deficiencies of the prior art, as will become evident to those of ordinary skill in the art after a study of the information presented in this document.

The present invention provides a safing sector assembly for a minigun. In contrast to the prior art minigun safety mechanisms disclosed in U.S. Pat. No. 7,703,374, the safing sector assembly of the present invention includes three distinct primary components which are operatively arranged to provide a two-step, dual safety mechanism with a rotatable top cover that provides quick, easy, and safe access to the bolt assemblies while the entire assembly is mounted to the minigun and enables electric rotations of its barrels. The safing sector assembly of the present invention is arranged to be mounted to the minigun main housing using existing locating features within the main housing of the minigun, thereby facilitating its ready adaption to all existing miniguns.

Accordingly, in one aspect, the invention provides a safing sector assembly for a minigun. The safing sector assembly includes a safing sector frame configured to be secured to the main housing of the minigun, a top cover hingedly attached to the frame, and a safing gate hingedly attached to the top cover. The frame includes an aft camming portion of an elliptical cam track of the minigun on an underside thereof. The top cover is configured to be rotatable, while the frame is secured to the main housing, between a closed position in which the top cover covers an access port in the main housing and an open position in which bolt assemblies of the minigun are accessible through the access port. The safing gate includes a forward camming portion of the elliptical cam track on an underside thereof. The safing gate is configured to be rotatable, while the frame is secured to the main housing, between an armed position in which the bolt assemblies follow the forward camming portion of the elliptical cam track to facilitate firing of the minigun, and a safe position in which the forward camming portion of the elliptical cam track is removed to thereby prevent firing of the machine gun. The safing gate is configured so as to only be rotatable to the armed position while the top cover is closed. The safing gate is also configured to latch the top cover closed, which prevents the top cover from being opened while the safing gate is in the armed position and ensures that the top cover can only be opened while the safing gate is in the safe position. Other aspects of the invention provide miniguns comprising a safing sector assembly disclose herein and methods of safing a minigun.

Numerous other objects, advantages and features of the present disclosure will be readily apparent to those of skill in the art upon a review of the following drawings and description of exemplary embodiments.

BRIEF DESCRIPTION OF THE SEVERAL VIEWS OF THE DRAWINGS

Non-limiting and non-exhaustive embodiments are described with reference to the following figures, wherein like reference numerals refer to like parts throughout the various drawings unless otherwise specified. In the drawings, not all reference numbers are included in each drawing, for the sake of clarity.

DETAILED DESCRIPTION

Figure 1:
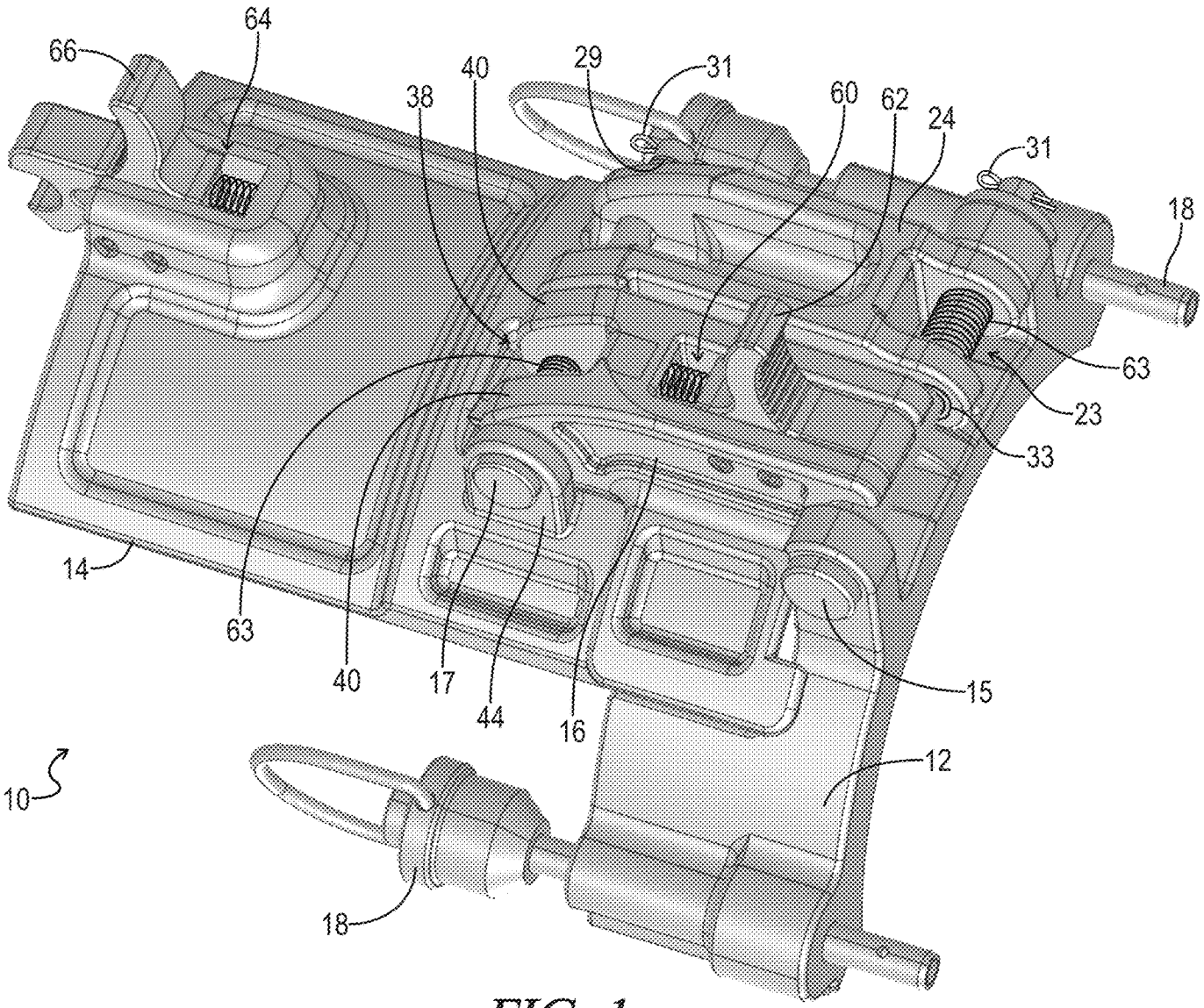
FIG. 1 is an elevated front perspective view of a safing sector assembly for a rotary machine gun constructed in accordance with an embodiment of the present invention.
Figure 2:
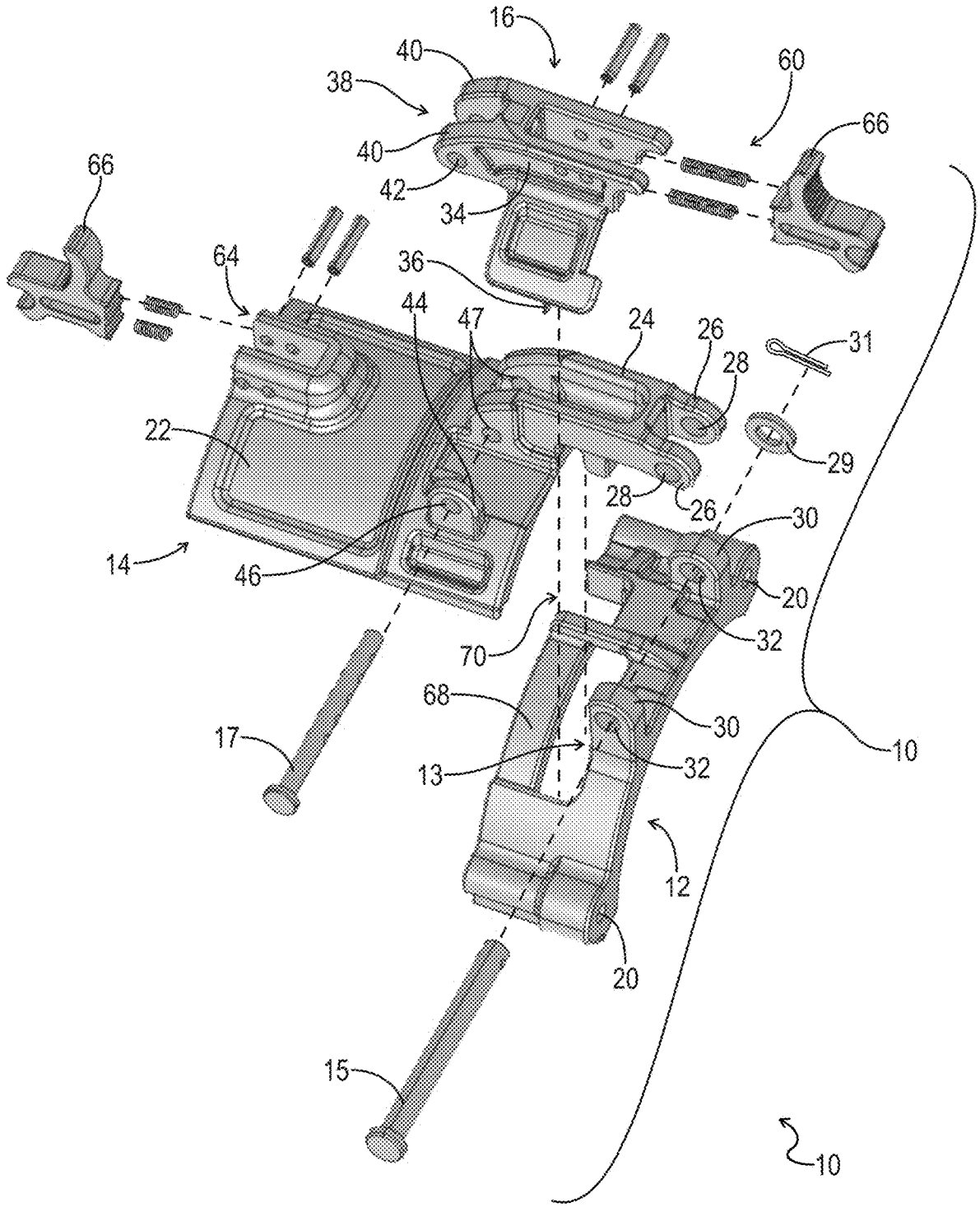
FIG. 2 is an exploded view of the safing sector assembly of FIG. 1. Locking retainer pins for releasably securing the assembly to the main housing, along with some washers, cotter pins, and torsion springs, are omitted for clarity.
Figure 3:
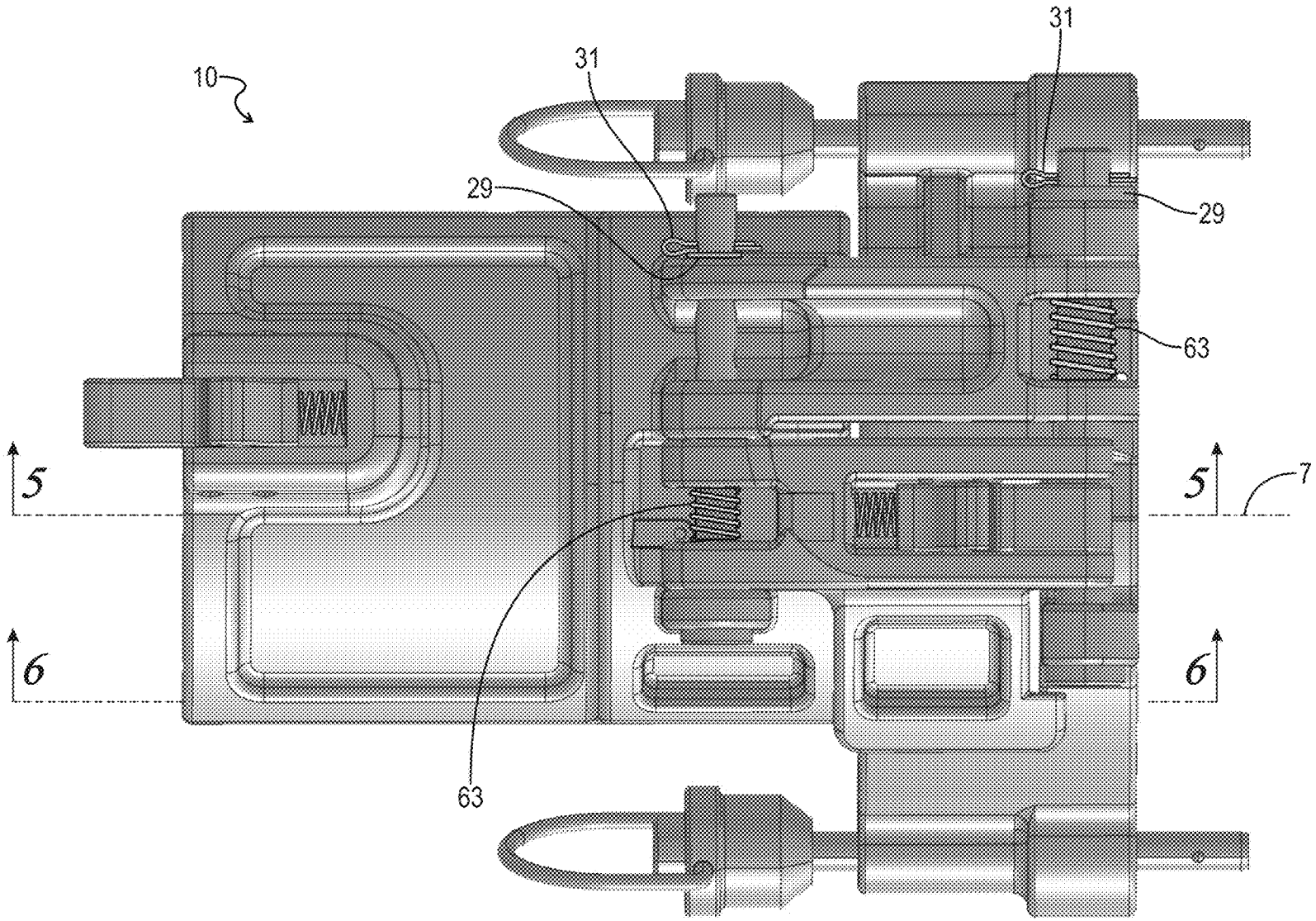
FIG. 3 is a top view of the safing sector assembly of FIG. 1.

The details of one or more embodiments of the present invention are set forth in this document. Modifications to embodiments described in this document, and other embodiments, will be evident to those of ordinary skill in the art after a study of the information provided herein. The information provided in this document, and particularly the specific details of the described exemplary embodiment(s), is provided primarily for clearness of understanding and no unnecessary limitations are to be understood therefrom. In case of conflict, the specification of this document, including definitions, will control.

While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention. Those of ordinary skill in the art will recognize numerous equivalents to the specific apparatus and methods described herein. Such equivalents are considered to be within the scope of this invention and are covered by the claims.

While the terms used herein are believed to be well understood by one of ordinary skill in the art, a number of terms are defined below to facilitate the understanding of the embodiments described herein. Unless defined otherwise, all technical and scientific terms used herein have the same meaning as commonly understood by one of ordinary skill in the art to which the subject matter disclosed herein belongs. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

As described herein, an "upright" position is considered to be the position of apparatus components while in proper operation or in a natural resting position. The upright firing position of a rotary machine gun is a generally level firing position. As used herein, the terms "aft" and "rear" means in a direction toward a rear end of a weapon, while the terms "front" and "forward" means in a direction extending away from the rear of the weapon toward the muzzles of the weapon. In some cases, the term "forward" can also mean forward beyond the muzzles of the weapon. "Vertical," "horizontal," "above," "below," "side," "top," "bottom," "upper," "lower," and other orientation terms are described with respect to this upright position during operation, unless otherwise specified, and are used to provide an orientation of embodiments of the invention to allow for proper description of example embodiments. A person of skill in the art will recognize, however, that the apparatus can assume different orientations when in use.

The term "when" is used to specify orientation for relative positions of components, not as a temporal limitation of the claims or apparatus described and claimed herein unless otherwise specified.

The terms "above", "below", "over", and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments.

All measurements should be understood as being modified by the term "about" regardless of whether the word "about" precedes a given measurement.

All references to singular characteristics or limitations of the present disclosure shall include the corresponding plural characteristic(s) or limitation(s) and vice versa, unless otherwise specified or clearly implied to the contrary by the context in which the reference is made.

All combinations of method or process steps as used herein can be performed in any order, unless otherwise specified or clearly implied to the contrary by the context in which the referenced combination is made.

The methods and devices disclosed herein, including components thereof, can comprise, consist of, or consist essentially of the essential elements and limitations of the embodiments described herein, as well as any additional or optional components or limitations described herein or otherwise useful.

Referring generally to FIGS. 1-15, there is shown a novel minigun safing sector assembly 10 constructed in accordance with an embodiment of the present invention. The safing sector assembly 10 includes a safing sector frame 12, a top cover 14, and a safing gate 16. The safing sector assembly 10 is adapted for external attachment over the bolt assembly access port 5 of any currently available minigun using existing locating features within the main housing 4 in a convenient and familiar manner.

Specifically, the safing sector frame 12 includes a pair of quick release positive locking retainer pins 18 which serve to releasably the secure safing sector assembly 10 to the main housing 4 of a minigun 2. The safing sector assembly 10 is secured to the main housing 4 by aligning a pair of mounting holes 20 in the safing sector frame 12 (see FIG. 1) with each respective pair of aft 6 and forward 8 locator holes in main housing 4 (see FIG. 15), and pushing retainer pins 18 forward through the respectively aligned holes 6, 20, and 8 until retainer pins 18 are fully inserted and locked in place (see FIG. 8). The safing sector assembly 10 can be quickly and easily removed from the minigun 2 in its entirety by withdrawing retainer pins 18 from the respectively aligned holes 8, 20 and 6. Removing the retainer pins 18 from mounting holes 20 and aft 6 and forward 8 locator holes releases the safing sector frame 12 from the main housing 4. This in turn permits the entirety of the safing sector assembly 10 to be easily lifted off of the minigun 2. Alternatively, retainer pins native to a predetermined minigun to which the operator desires to secure a safing sector assembly 10 of the present invention can be used in lieu of retainer pins 18.

Figure 16:
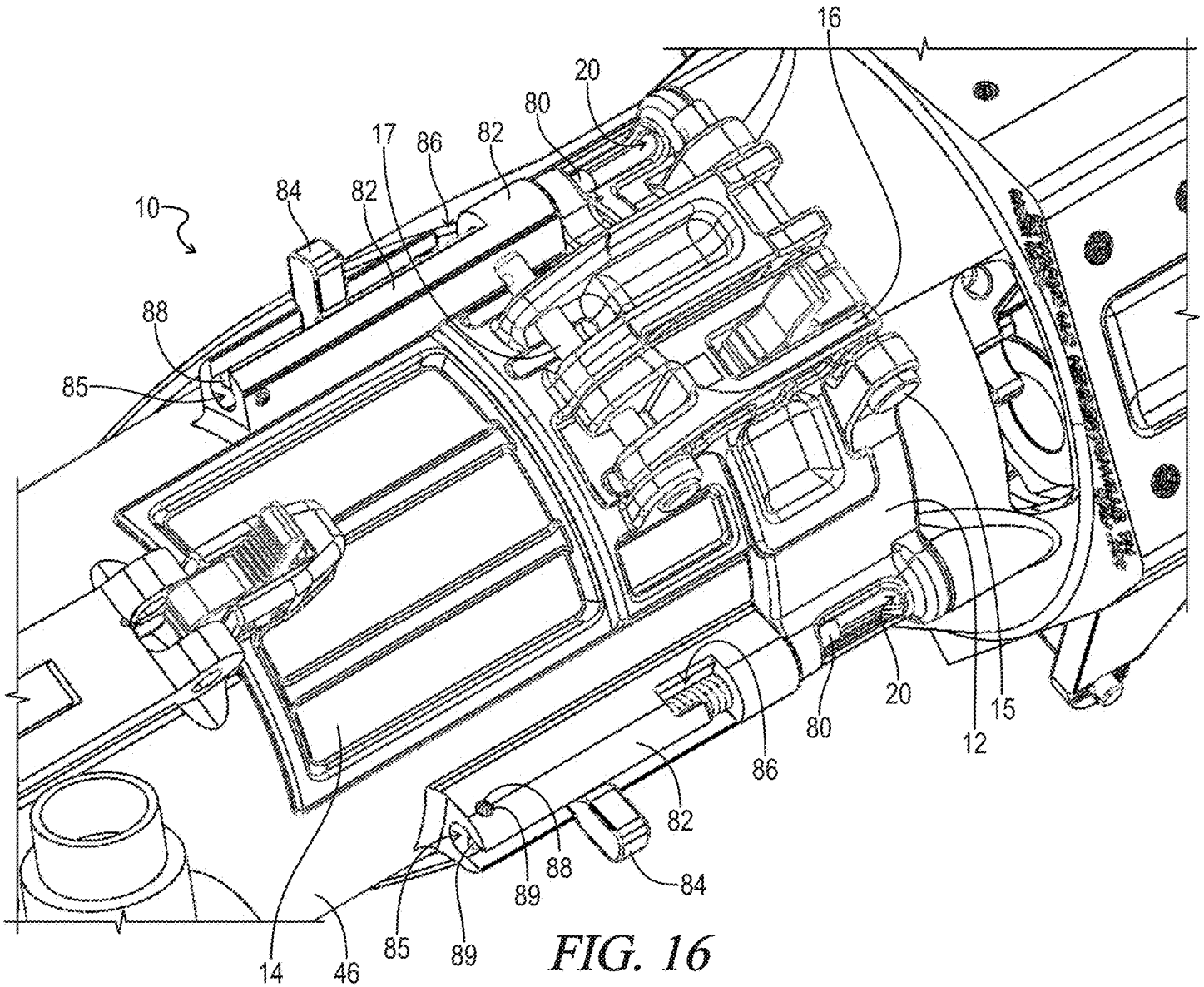
FIG. 16 is an elevated rear perspective view a safing sector assembly for a rotary machine gun constructed in accordance with another embodiment of the present invention.
Figure 17:
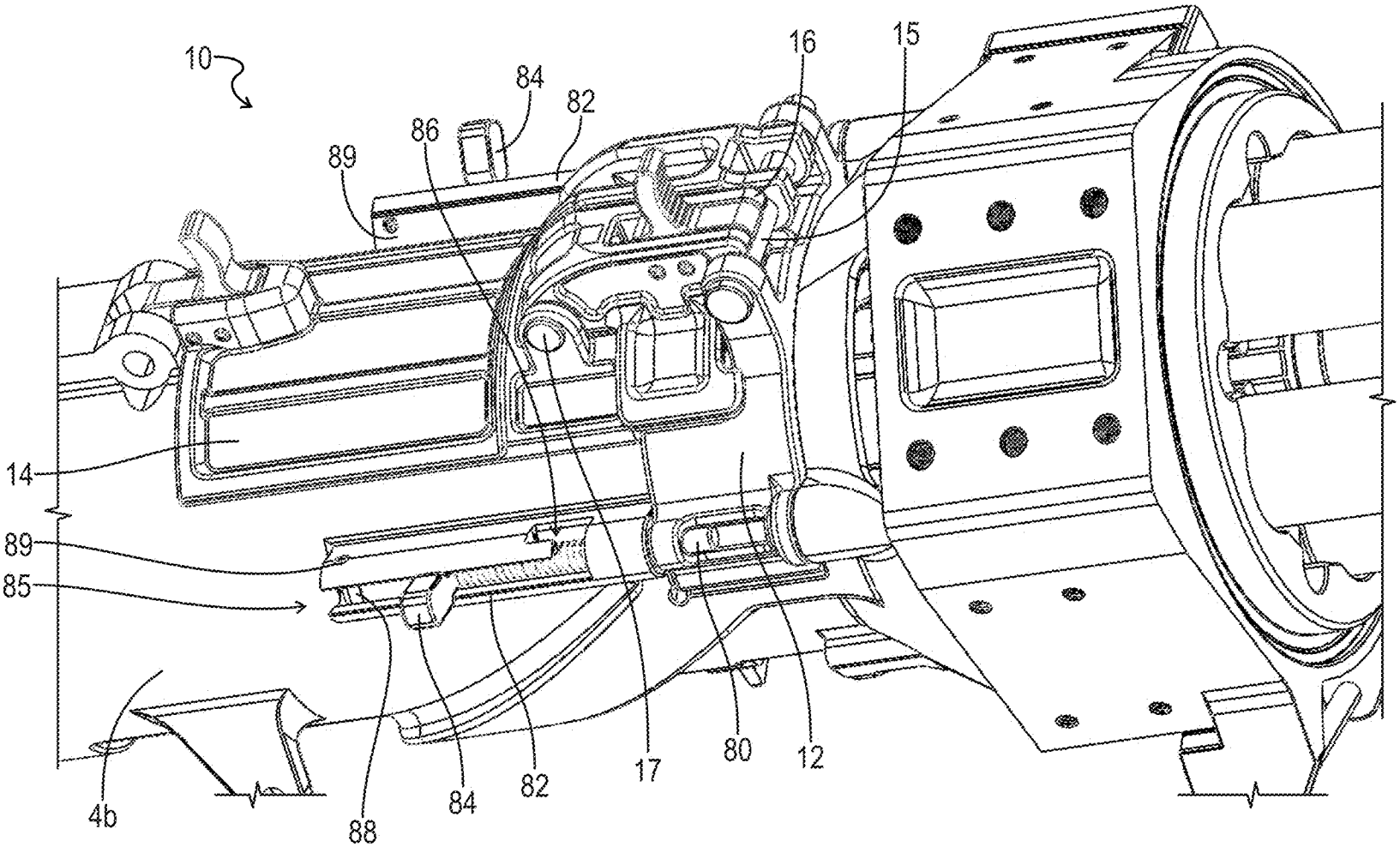
FIG. 17 is another perspective view of the safing sector assembly of FIG. 16.
Figure 18:
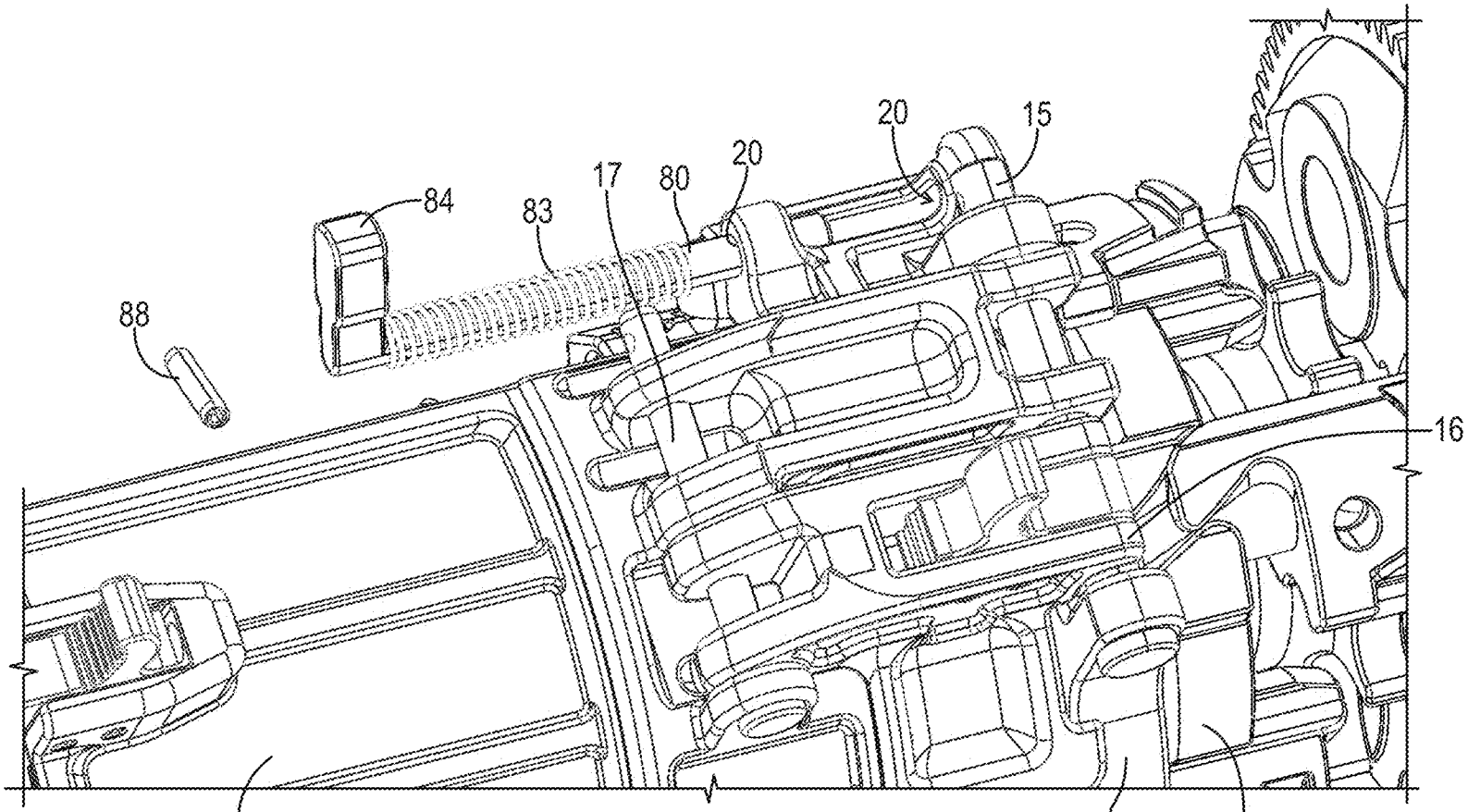
FIG. 18 is yet another perspective view of the safing sector assembly of FIG. 16 in which the retainer pin housing for the illustrated retainer pin is omitted for clarity.

In another embodiment, as depicted in FIGS. 16-18, locking retainer pins 18 and main housing 4 are replaced with spring-loaded retainer pins 80 and main housing 4*b*. Spring-loaded retainer pins 80 are contained within and captured by a pair of retainer pin housings 82 on main housing 4*b*. The retainer pin housings 82 can be integrally formed on main housing 4*b* or separately formed and subsequently attached to main housing 4*b*. Spring-loaded retainer pins 80 serve to attach the safing sector frame 12 to the main housing 4*b*. Retainer pins 80 are spring loaded in their open or retracted position and extend through the mounting holes 20 of the safing sector frame 12 into the forward locator holes 8 in the main housing 4*b*. The safing sector frame 12 is attached to main housing 4*b* by pushing retainer pins 80 forward through a passage 85 in each retain pin housing 82 and against the pressure applied by the retainer springs 83, into forward locator holes 8 within main housing 4*b* and then locking them into the forward position by rotating thumb tabs 84 of each of the retainer pins 80 into their respective retainer pin notches 86. Rearward spring pressure applied by the retainer springs 83 locks the thumb tab 84 of each retainer pin 80 in their respective retainer pin notches 86.

A plunger keeper 88 received through a pair of concentrically aligned holes 89 in the rear of each retain pin housing 82 prevents the retainer pins 80 from being pushed rearwardly out the passage 85 in the retainer pin housings 82 by the springs 83 when the thumb tabs 84 are not received in their respective retainer pin notches 86. In this way, the retainer pins 80 are captured by their respective retainer pin housings 82, and as such, are not removable therefrom unless specifically released by rotating the thumb tabs 84 out of the retainer pin notches 86 and removing the plunger keepers 88 from their respective aligned holes 89. Integrating the retain pins 80 into the main housing 4 in this way retains the pins 80 on the main housing 4*b* to prevent their inadvertent loss during use or repairs (e.g., when the safing sector assembly 10 is removed from main housing 4*b*). It also ensures that the pins 80 are always in the same place during use, which in turn ensure that the movements necessary to remove or reinstall the safing sector assembly 10 are predictable and repeatable.

The arrangement of the instant spring-loaded retain pins 80 and pin housings 82 differ from the retainer pins used in the prior art safety mechanisms disclosed in U.S. Pat. No. 7,703,374 in that the original 1960s top cover and safing sector design did not use pins captured against the housing, while the newer mechanism covered by the aforementioned patent integrated the pins into the top cover portion of the safing sector unit itself, so that they do not remain on the minigun main housing when the safety mechanism assembly is removed from the main housing.

Referring generally to FIGS. 1 through 18, the top cover 14 is releasably secured to the safing sector frame 12 by a primary retainer pin 15. The top cover 14 pivots about primary retainer pin 15 between a closed position wherein the top cover covers or closes the bolt assembly access port 5 defined in the main housing 4 of the minigun 2 (see FIG. 8), and an open position wherein the access port 5 is not covered and the bolt assemblies 7 are manually accessible therethrough (see FIGS. 10 and 14). Primary retainer pin 15 can be a clevis-type pin (e.g., a universal or grooved clevis pin). The top cover 14 includes a main cover body 22 and an arm 24 on the body 22. The arm 24 extends forwardly from a forward portion of the main cover body 22. A distal end of the arm 24 terminates beyond a forward end of the main body 22 in a fork 23 defined by a pair of spaced apart tabs 26. Each tab 26 includes a hole 28 defined therethrough. The safing sector frame 12 includes a pair of spaced apart ears 30 extending therefrom. Each ear 30 includes a hole 32 defined therethrough and is positioned proximate the forward end of the safing sector frame 12. The tabs 26 of the fork 23 are arranged between the ears 30 on the safing sector frame 12 such that the holes 28 in the tabs 26 are concentrically aligned with the holes 32 in the ears 30. The primary retainer pin 15 extends through the aligned holes 28, 32 and is secured therein. In some embodiments, the primary retainer pin 15 can be secured with a washer 29 and a cotter pin 31. A retaining ring 33 can be positioned on the retainer pin 15 and engage a hole or groove therein at one or both exterior sides of the fork tabs 26 to prevent axial movement of the arm 24 along the retainer pin 15 and thereby hold the arm 24 in place on the pin 15.

The safing gate 16 is releasably secured to the top cover 14 by and pivots about a secondary retainer pin 17. Secondary retainer pin 17 can be another clevis-type pin (e.g., a universal or grooved clevis pin). The safing gate 16 includes a main gate body 34 and a ramp 36. The ramp 36 extends downwardly from the underside of the main gate body 34. The body 34 of the safing gate 16 is attached to a forward portion of the top cover 14. In some embodiments, the main gate body 34 can be positioned adjacent the arm 24. A rear end of the main gate body 34 includes a pair of spaced apart tabs 40 which define a fork 38. Each tab 40 includes a hole 42 defined therethrough. The main cover body 22 includes a protrusion 44 spaced to one side of the arm 24. A hole 46 is defined through the protrusion 44. The arm 24 includes one or more concentrically aligned holes 47 defined therethrough. The tabs 40 of the fork 38 on the main gate body 34 are arranged between the arm 24 and the protrusion 44 on the main cover body 22 such that the holes 42 in the tabs 40 are concentrically aligned with the holes 46, 47 in the protrusion 44 and the arm 24, respectively. The secondary retainer pin 17 extends through the aligned holes 46, 42, 47 and is secured therein. In some embodiments, the secondary retainer pin 17 can be secured with a washer 29 and a cotter pin 31. A retaining ring (not shown) can be positioned on the retainer pin 17 and engage a hole or groove therein at one or both exterior sides of the fork tabs 40 to prevent axial movement of the safing gate 16 along the retainer pin 17 and thereby hold the safing gate 16 in place on the pin 17.

Figure 4:
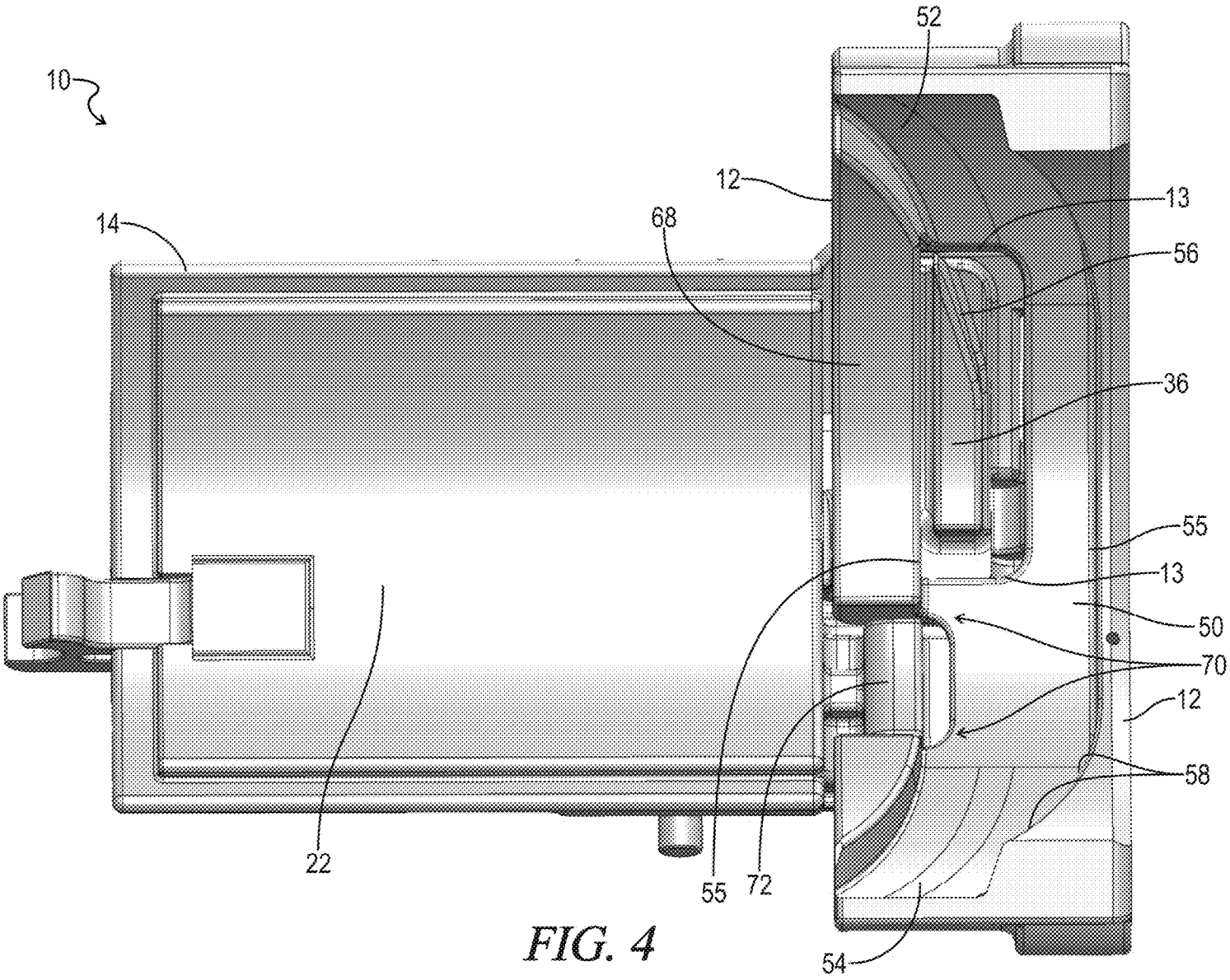
FIG. 4 is a bottom view showing the underside of the safing sector assembly of FIG. 1.
Figure 5:
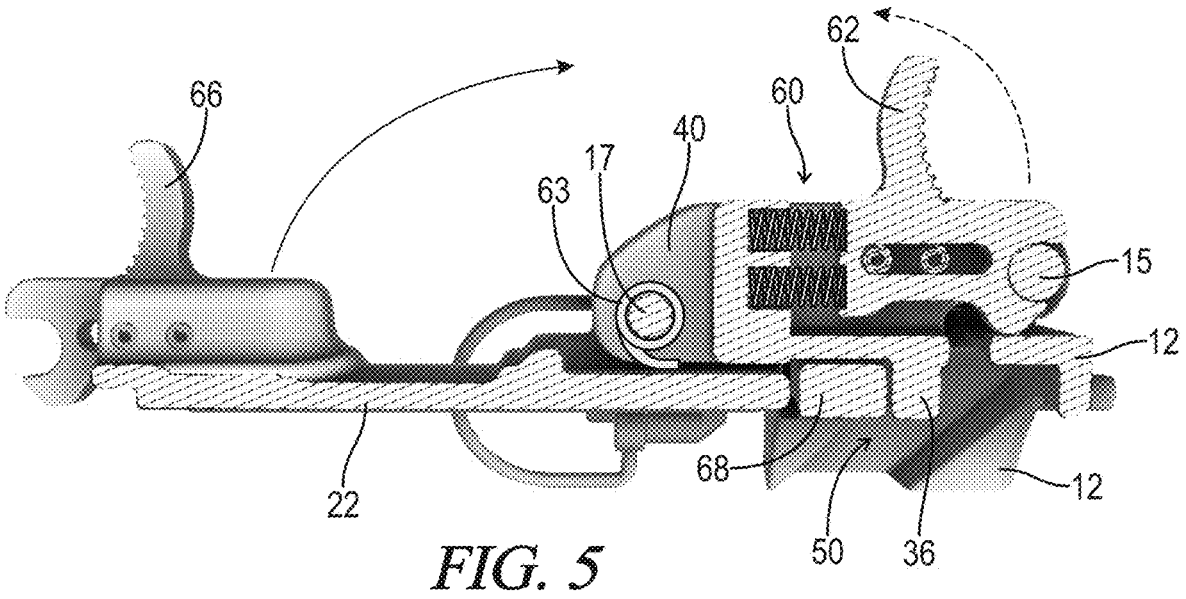
FIG. 5 is a sectional view taken along line 4-4 of the safing sector assembly of FIG. 3.
Figure 6:
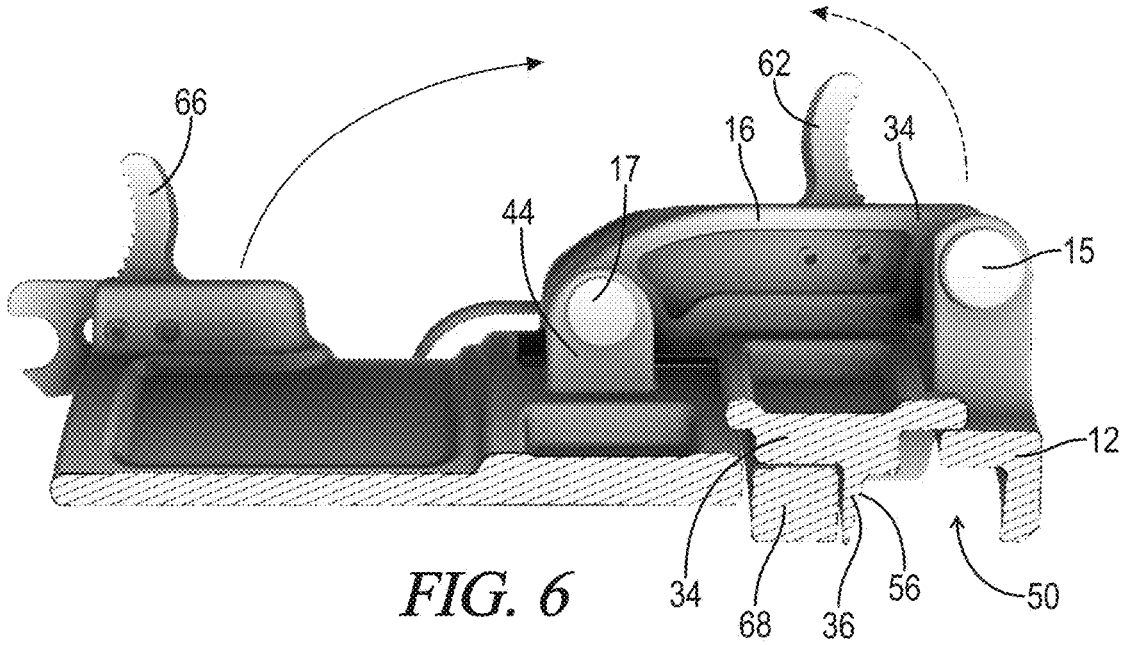
FIG. 6 is a sectional view taken along line 5-5 of the safing sector assembly of FIG. 3.
Figure 7:
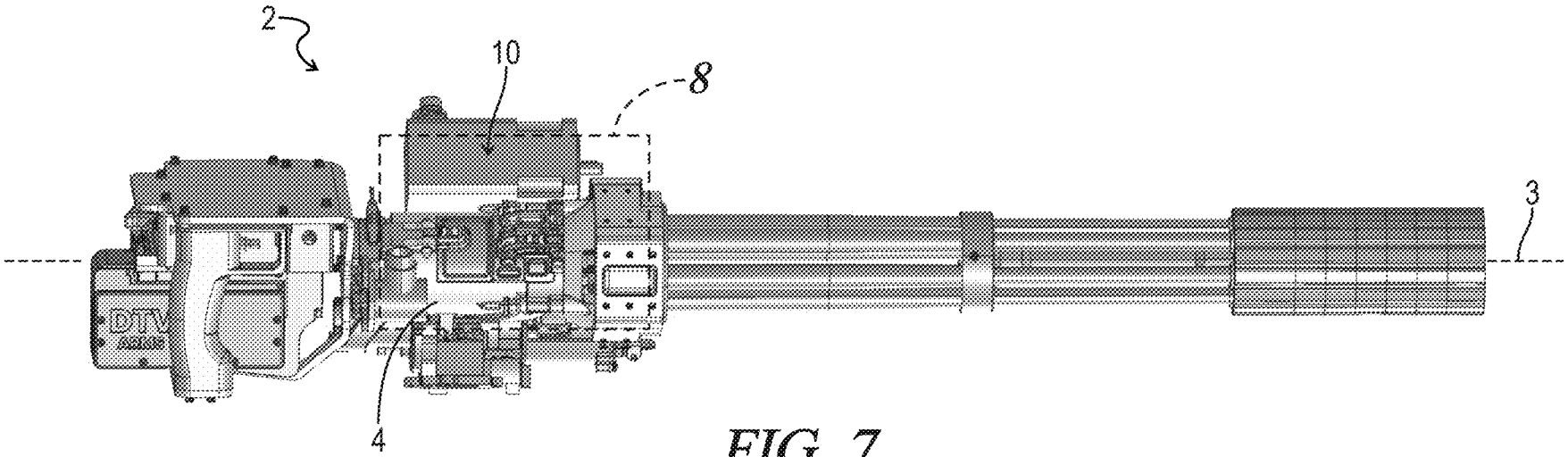
FIG. 7 is an elevated right-side perspective view an exemplar M134 "minigun" rotary machine gun with the safing sector assembly of FIG. 1 mounted thereon. The safing sector assembly is shown in an armed and ready-to-fire configuration with the top cover in the closed position and the safing gate in the armed (closed) position. Some components of the gun are omitted for clarity.

As best shown in FIGS. 4-6, an elliptical cam track 50 is provided in safing sector frame 12. The elliptical cam track 50 extends longitudinally within the main housing 4 of the minigun 2 (see FIG. 15). Each bolt assembly 7 includes a roller bearing 9 that rides in the elliptical track 50. As the barrels of the minigun 2 rotate, the bolt assemblies 7 enter elliptical track 50 at location 52 of FIG. 4 and exit elliptical track 50 at location 54. Elliptical track 50 includes forward and aft camming portions 56, 58, respectively. Camming portions 56, 58 of elliptical track 50 are both bearing surfaces that force the bolt assemblies 7 in forward and aft directions, respectively. A straight section of elliptical track 50, illustrated by sidewalls 55 of FIG. 4, serves as a guide between forward and aft camming portions 56, 58, and does not produce a camming action. As the bolt assemblies 7 enter elliptical track 50 at location 52 and are forced forward by forward camming portion 56 thereof, the firing pin of each bolt assembly 7 is placed under heavy spring pressure in preparation for firing a respective cartridge. Just prior to a given bolt assembly 7 cresting forward camming portion 56 of elliptical track 50 and entering the straight section thereof defined by sidewalls 55, the cartridge is fired and the spring pressure is released. The period of time a cartridge spends in the straight section of the elliptical cam track is known as "dwell time." The bolt assembly 7 continues through the straight section of elliptical track 50 defined by sidewalls 55 until reaching aft camming portion 58 of elliptical track 50, at which point the bolt assembly 7 is forced in the aft direction, guiding the bolt assembly 7 back into the portion of elliptical track 50 within main housing 2.

It is forward camming portion 56 of elliptical track 50 formed by the ramp 36 on the underside of the safing gate body 34 that causes a cartridge to be fired, and aft camming portion 58 of elliptical track 50 formed on the safing sector frame 12 that redirects the bolt assembly 7 and guides it back into the elliptical track 50 within main housing 4. When safing the minigun 2 by partially or completely removing the safing gate 16, it is the removal of forward camming portion 56 of elliptical track 50 that inhibits the minigun 2 from firing.

Figure 8:
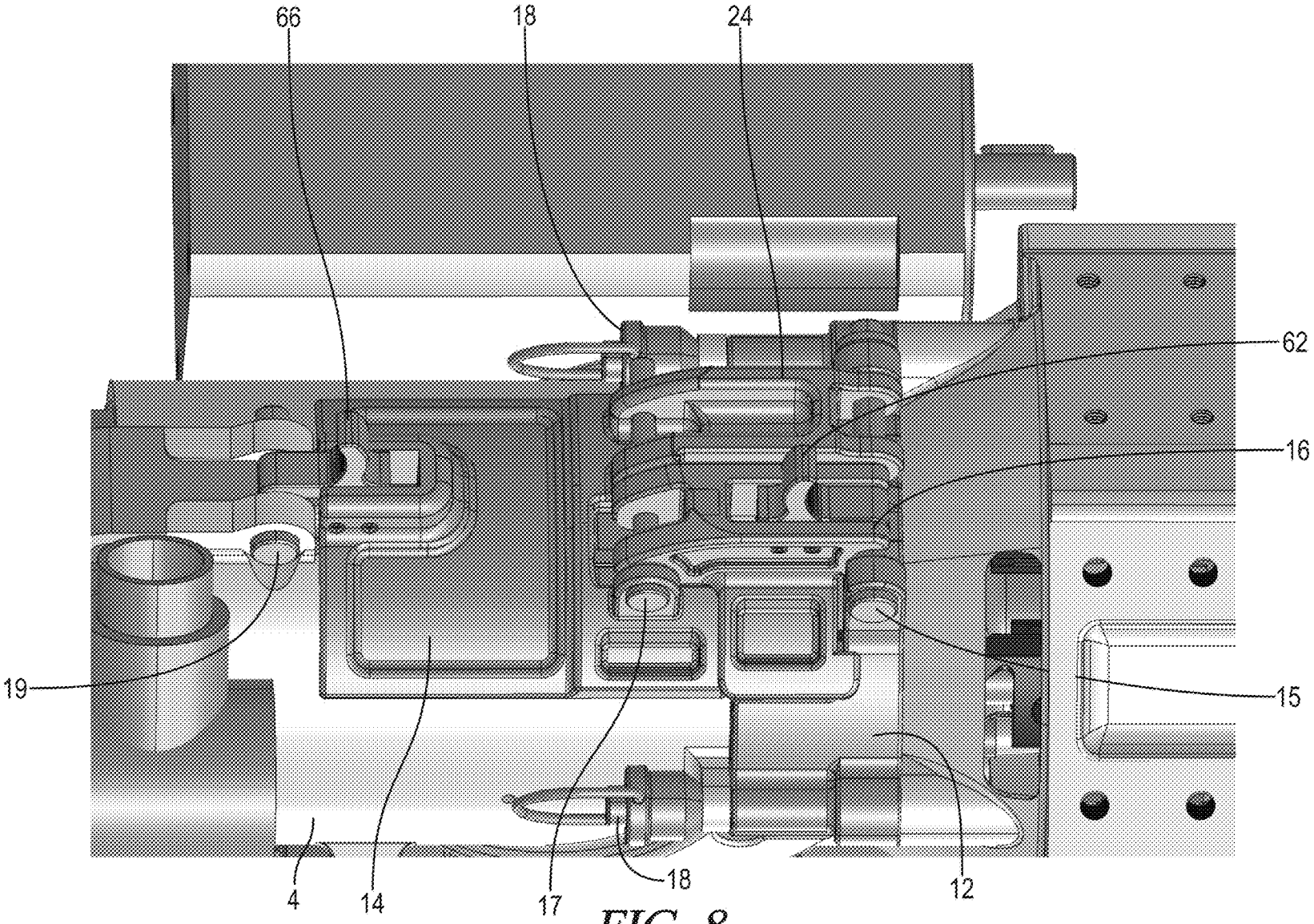
FIG. 8 is an enlarged detail view of the objects of FIG. 7 at location 8. Washers, retaining rings, cotter pins, springs are omitted for clarity.

Consequently, when the safing gate is in its closed or armed position, as illustrated in FIG. 8, the ramp 36 extends downwardly from the safing gate body 34 through an aperture 13 in the safing sector frame 12 into a portion of the elliptical cam track 50, thereby introducing to elliptical track 50 the critical forward camming portion 56 necessary for firing. The safing gate 16 is configured to fire a cartridge once the cartridge reaches the 2:30-3:00 o'clock position in order to give the cartridge more dwell time in the elliptical cam track 50. This enables miniguns equipped with the safing sector assembly 10 of the present invention to function with a larger variety of ammunition, including ammunition with slower igniting primers, from around the world, thereby mitigating out of battery detonations. This is in contract to prior art miniguns and safing mechanisms which fired cartridges at the 1:00 to 2:00 o'clock positions and did not reliably function with ammunition using slow igniting primers.

When the safing gate 16 is in an open or safe position and the gun is safed, as exemplified in FIGS. 9-13, forward camming portion 56 of elliptical track 50 formed by ramp 36 is removed from the overall length of the elliptical track 50, leaving the aft camming portion 58 thereof in place. With the critical forward camming portion 56 of the elliptical track 50 removed and the aft camming portion 58 retained in its operational position, the barrels of the minigun 2 may be rotated electrically without it firing and without the bolt assemblies 7 thereof being damaged. The geometry of forward and aft camming portions 56, 58 of the elliptical track 50 in the safing sector assembly 10 of the present invention is universally compatible with existing miniguns of all makes.

The safing gate 16 is secured in its closed or armed position by a latching mechanism 60 incorporated in the gate body 34. The latching mechanism 60 is spring-loaded in its extended or locked position engaging the primary retainer pin 15 on the safing sector frame 12. The latching mechanism 60 is released or retracted by pulling a trigger 62 rearwardly against the pressure exerted by the spring. When the trigger 62 is pulled, latching mechanism 60 is retracted to clear the primary retainer pin 15 which then allows the safing gate 16 to be rotated toward its open or safe position.

Figure 9:
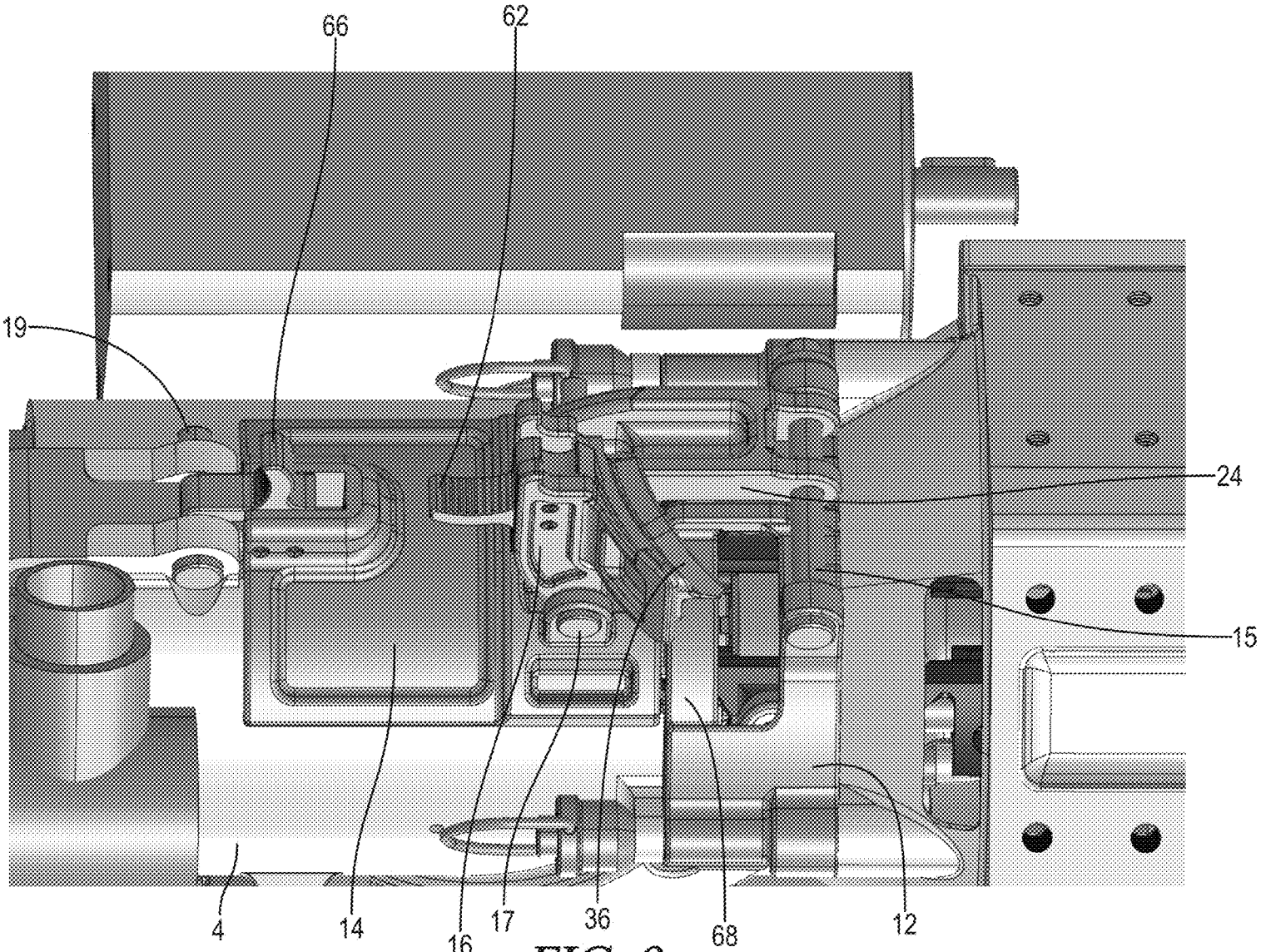
FIG. 9 is another view the objects of FIG. 8 showing the safing sector assembly in a safed configuration with the top cover in the closed position and the safing gate in the safe (open) position.
Figure 10:
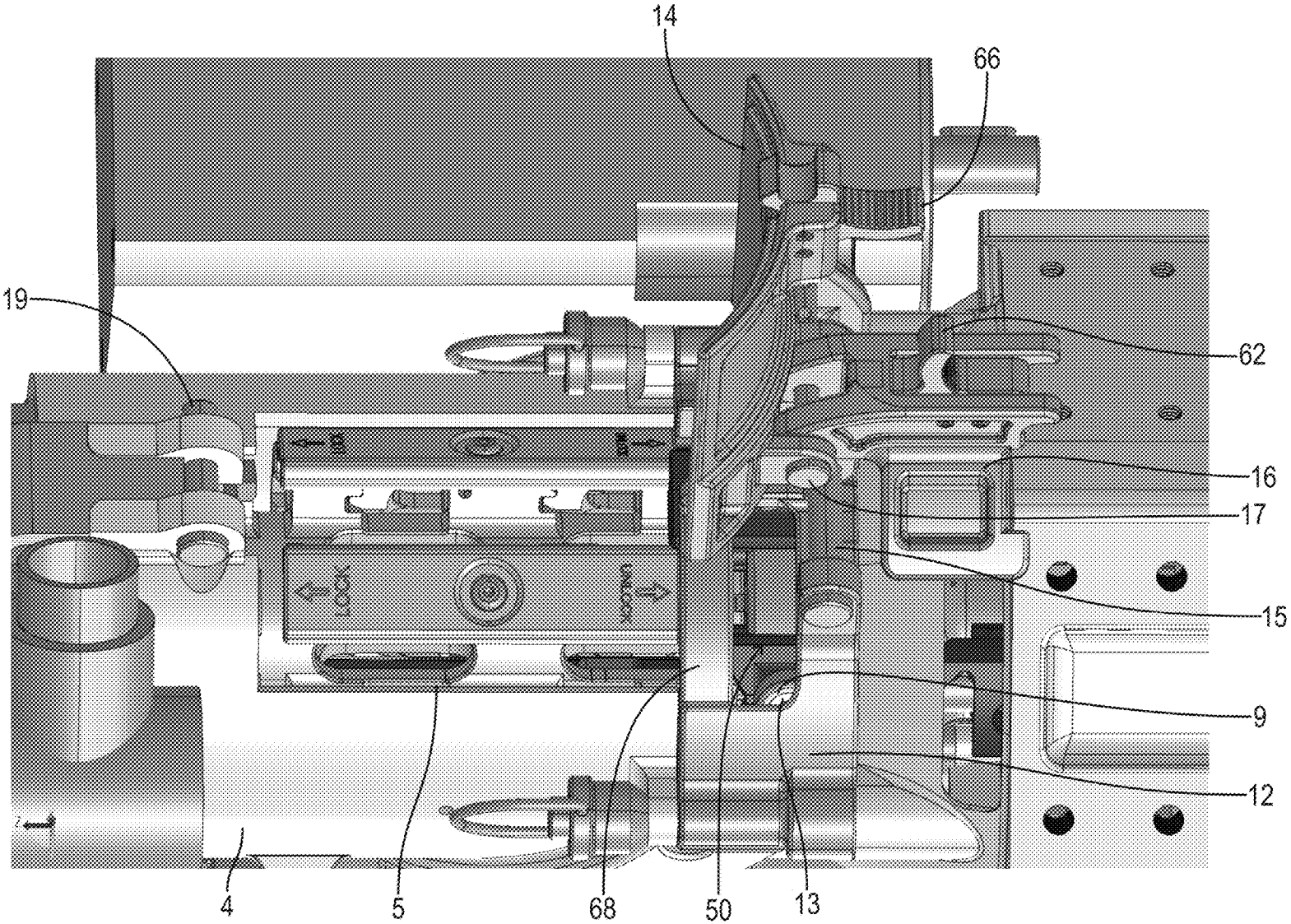
FIG. 10 is another view the objects of FIG. 8 showing the safing sector assembly in an open configuration with the top cover in the open position and the safing gate in the safe (open) position.
Figure 11:
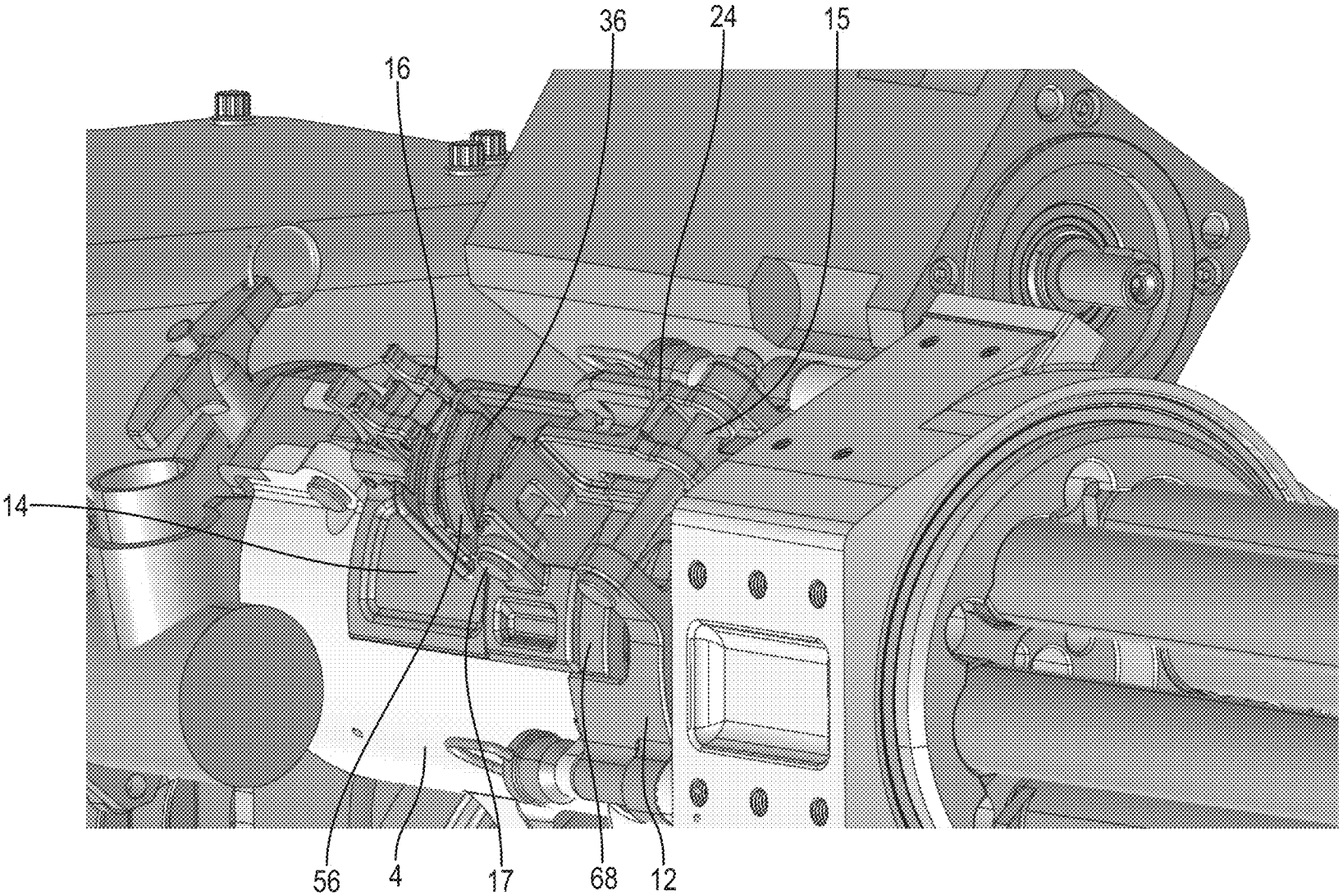
FIG. 11 is a front perspective view of the objects of FIG. 9.
Figure 12:
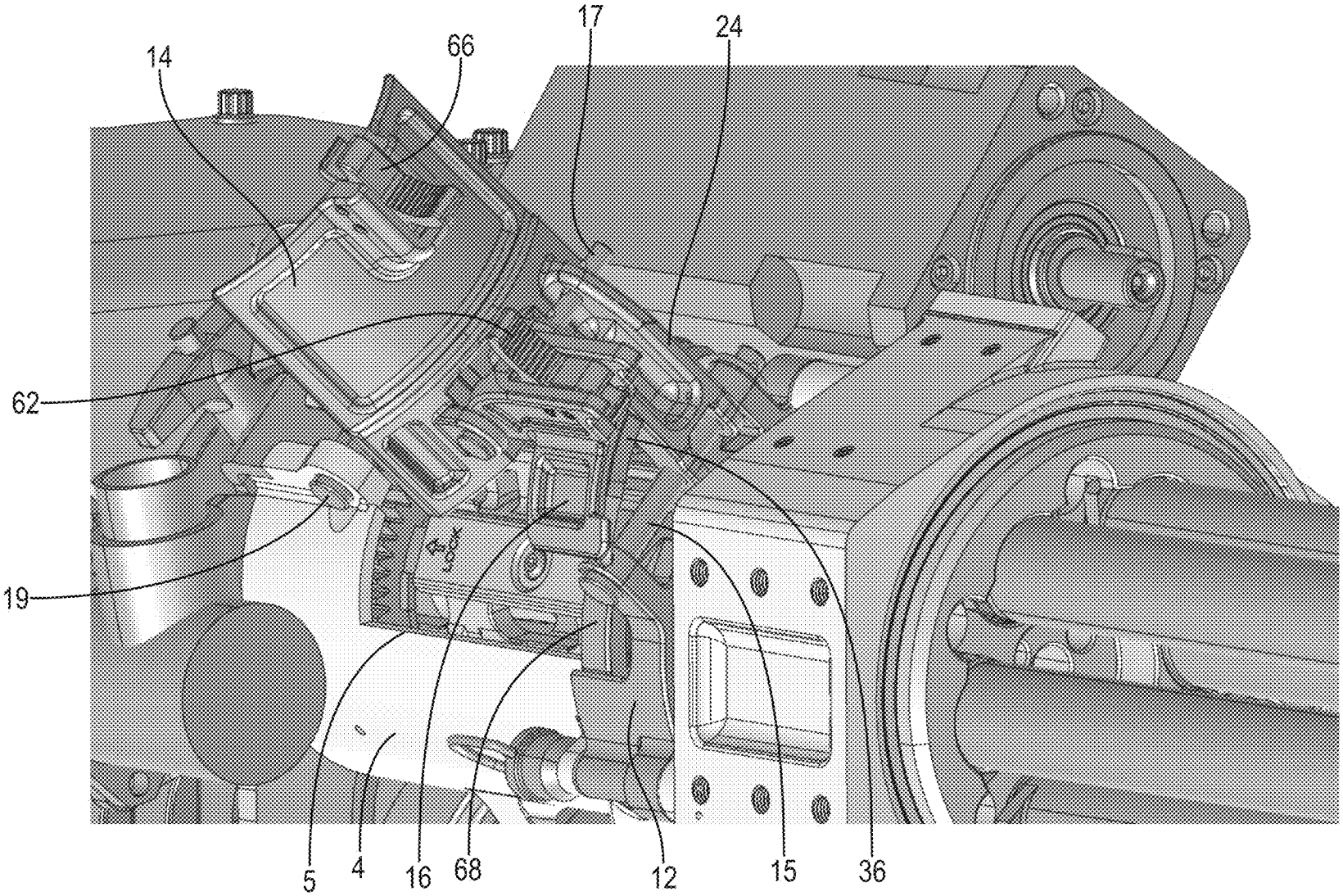
FIG. 12 is a front perspective view of the objects of FIG. 10.
Figure 13:
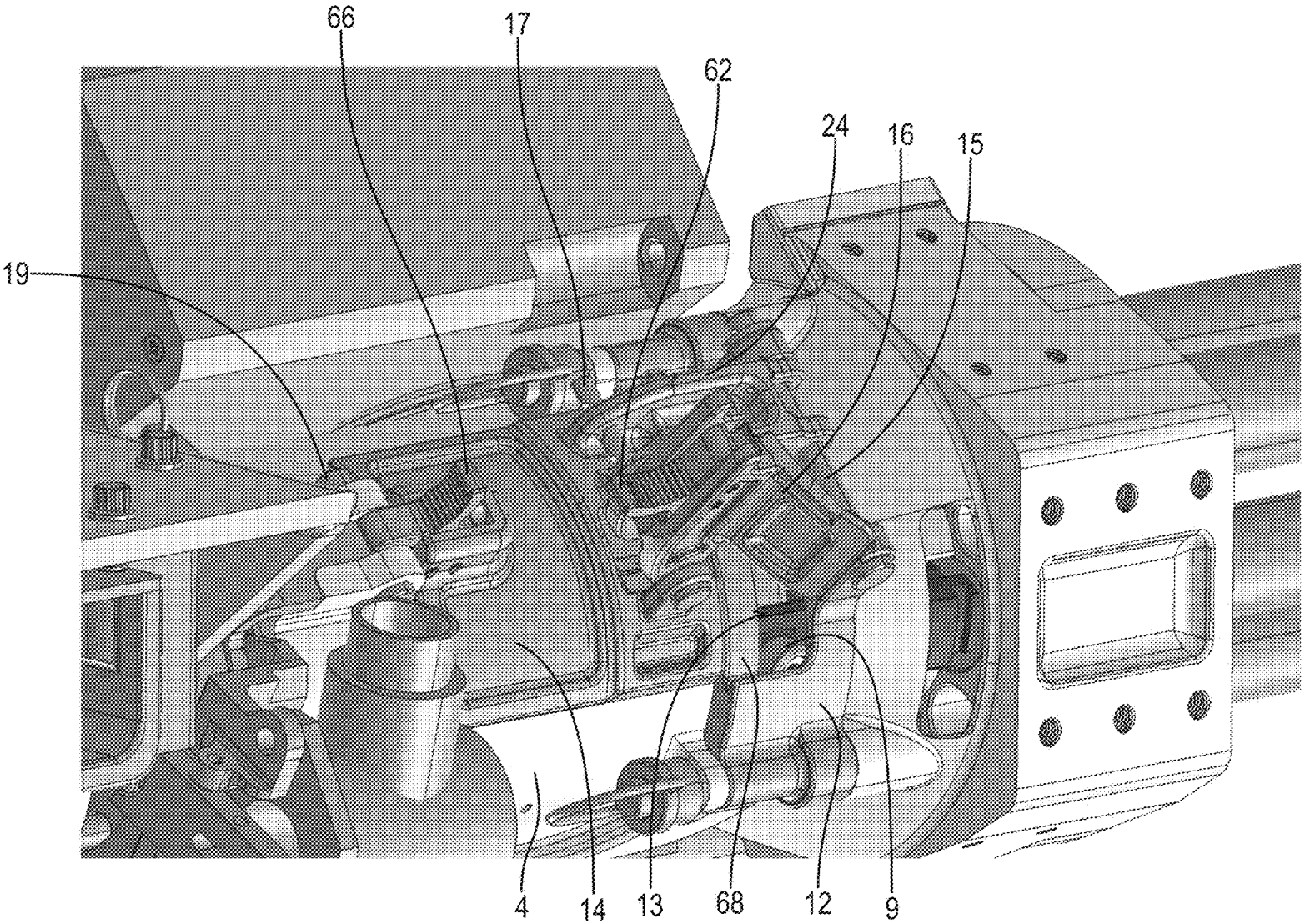
FIG. 13 is a rear perspective view of the objects of FIG. 9.
Figure 14:
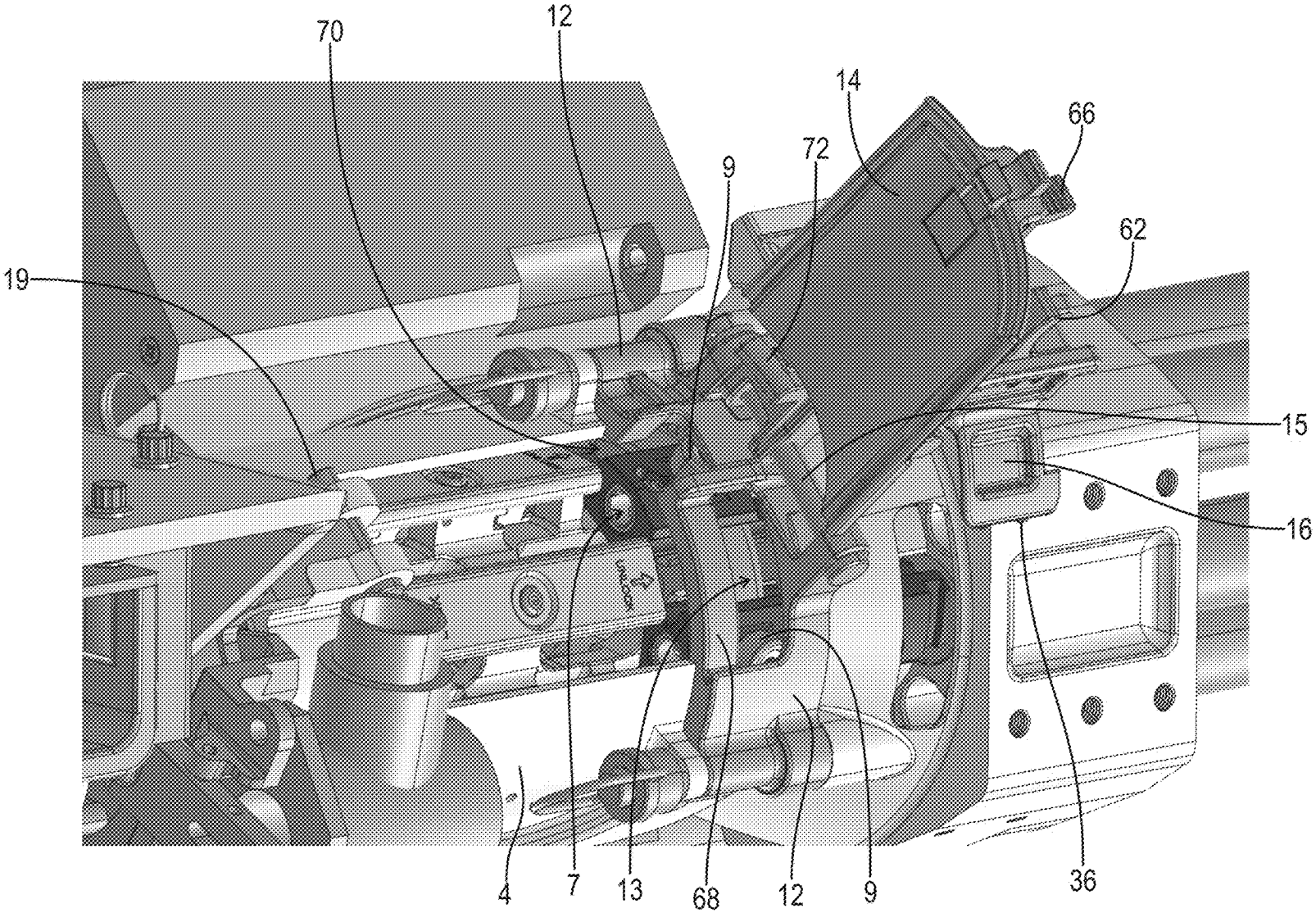
FIG. 14 is a rear perspective view of the objects of FIG. 10.
Figure 15:
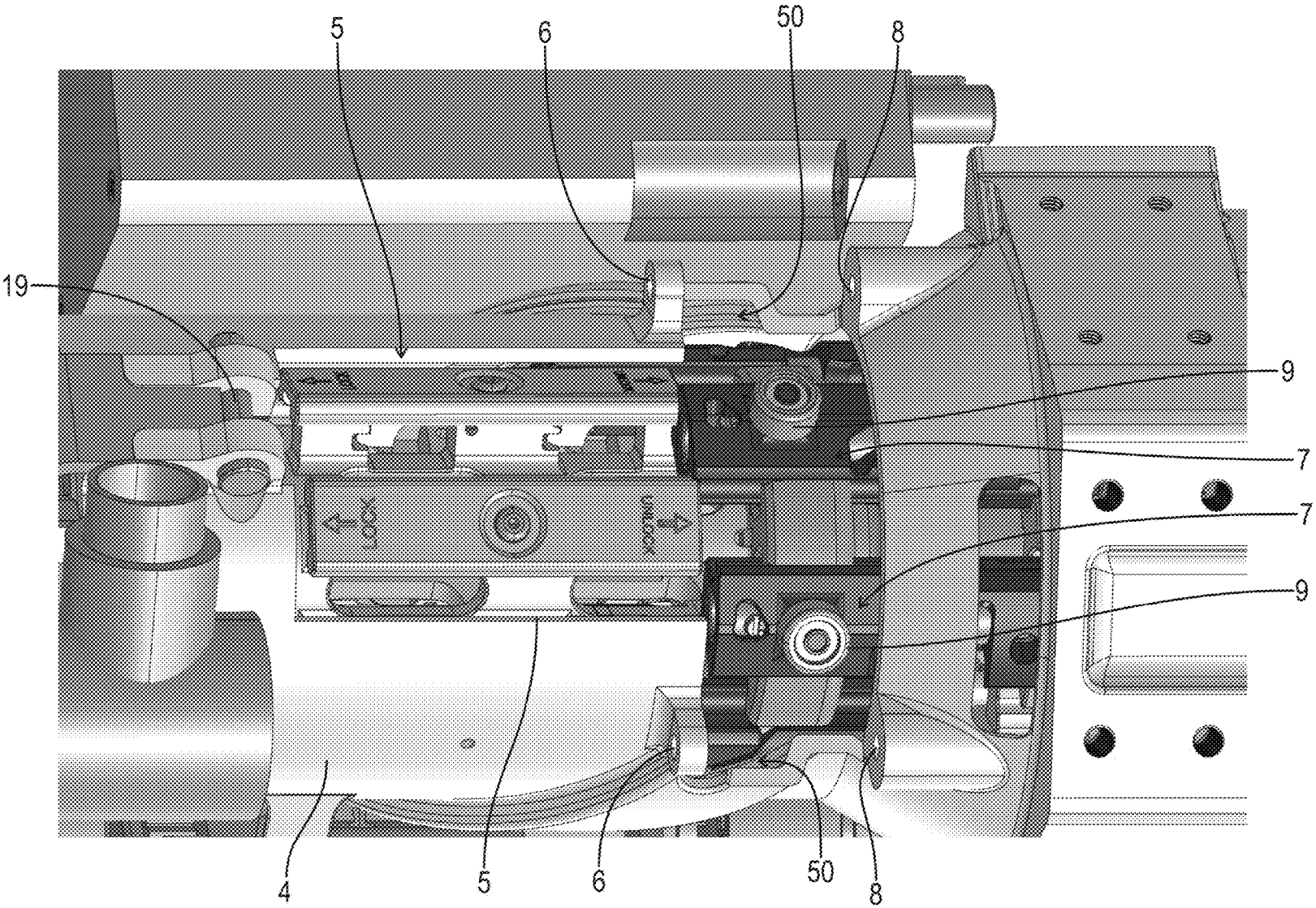
FIG. 15 is another view of the objects of FIG. 8 with the safing sector assembly removed to reveal the bolt assemblies of the machine gun accessible through the access port defined in the main housing.

In order to safe the minigun, the safing gate 16 must be rotated rearwardly from its closed or armed position, as illustrated in FIG. 8, to its open or safe position, as illustrated in FIGS. 9, 11, and 13. The operator accomplishes this by pulling trigger 62 and rotating safing gate 16 rearwardly. The safing gate 16 rotates about the secondary retainer pin 17 through a reference plane 7 which contains the central longitudinal axis 3 of the gun 2. A torsion spring 63 on the secondary retainer pin 17 of the top over 14 is arranged to push the safing gate 16 toward the open position when the safing gate 16 is unlocked from engagement with the primary retainer pin 15 in the armed position. The torsion spring 63 can be situated in the fork 38 between the tabs 40 of the gate body 34. Safing gate 16 will remain open and the machine gun will remain safed until the operator rotates the safing gate 16 forwardly back into the armed position. Safing gate 16 can be locked in its armed position by first pulling trigger 62 before rotating the safing gate 16 forwardly into the armed position, or by rapidly rotating safing gate 16 downward to thereby force latching mechanism 60 into engagement with the primary retainer pin 15.

The top cover 14 is secured in its closed position by a latching mechanism 64 on the top cover main body 22. Like latching mechanism 60 on the safing gate 16, latching mechanism 64 on the top cover 14 is spring-loaded in its extended or locked position. However, unlike latching mechanism 60, latching mechanism 64 is spring-loaded in the opposite direction (i.e., rearwardly) into engagement with a tertiary retainer pin 19 native to the main housing of the minigun 2. The latching mechanism 64 is released or retracted by pushing a trigger 66 forwardly against the pressure exerted by a spring. When the trigger 66 is pushed, the latching mechanism 64 is retracted to clear the tertiary retainer pin 19. This frees the rear end of the top cover 14 from the tertiary retainer pin 19. However, even when unlatched from the tertiary retainer pin 19, the top cover 14 is only rotatable from its closed to its open position while the safing gate 16 is in its safe position because the safing gate 16 is operatively arranged to latch the top cover 14 closed while the safing gate 16 is its armed position. The top cover 14 thus cannot be opened while the safing gate 12 is closed or armed. Instead, the top cover 14 can only be opened while the safing gate 16 is open or safed.

To explain, the aperture 13 in the safing sector frame 12 is defined in part by a sidewall 68 of the safing sector frame 12. The aperture 13 is rearward of the ears 30 on the frame 12 and primary retainer pin 15 about which the top cover 14 is rotatable. The sidewall 68 defines part of the rear end of the safing sector frame 12. As such, the sidewall 68 is rearward of the aperture 13. As best shown in FIGS. 4-6, the ramp 36 of the safing gate 16 is received in the aperture 13 adjacent the sidewall 68 when the safing gate 16 is in the closed or armed position. The top cover 14 is arranged to pivot forwardly about the primary retainer pin 15 and through the reference plane 7 when the top cover 14 is rotated from the closed to the open position. However, because the safing gate 16 is releasably secured to the forward portion of the top cover 14 by the secondary retainer pin 17, the safing gate 16 must necessarily pivot with the top cover 14 when the top cover 14 is rotated forward. Consequently, the top cover 14 carries the safing gate 16 when the top cover is rotated about primary retainer pin 15. However, when forward rotation of the top cover 14 is attempted while the safing gate 16 is in the closed or armed position (indicated by a solid arrow in FIGS. 5 and 6), the ramp 36 will contact the sidewall 68 of the safing sector frame 12 and block forward rotation of the top cover 14. In this way, the top cover 14 is prevented from being rotated out of the closed position while the safing gate 16 is in the armed position.

To open the top cover 14, the safing gate 16 must first be rotated rearwardly to the open or safe position (indicated by a dashed arrow in FIGS. 5 and 6), which safes the minigun 2. The operator may then push trigger 66 to release the latching mechanism 64 from tertiary retainer pin 19 and rotate the top cover 14 forwardly toward the open position. Forward rotation of the top cover 14 carries the safing gate 16 away from the safing sector frame 12 and thereby prevents the safing gate 16 from being rotated back into to the armed position while the top cover 14 is in the open position. A torsion spring 63 on the primary retainer pin 15 of the safing sector frame 12 is arranged to push the top cover 14 toward the open position when the top cover 14 is unlocked from engagement with the tertiary retainer pin 19 and the safing gate 16 is in the safed position. The torsion spring 63 can be situated in the fork 23 between the tabs 26 of the main body 22.

The top cover 14 will remain open, and the machine gun will remain safed, until the operator first rotates the top cover 14 rearwardly back down into the closed position and then rotates the safing gate 16 forwardly into the armed position. Consequently, the top cover 14, once opened, must be closed again before the safing gate 16 can be closed or armed and the forward camming portion 56 reintroduced into the elliptical cam track 50 to make the machine gun 2 ready to fire. In this way, the top cover 14 is operatively arranged to prevent the safing gate 16 from being rotated to the armed position unless the top cover 14 is in the closed position, so the safing gate 16 can only be placed in the armed position while the top cover 14 is closed. As such, two steps are required to re-arm the minigun after the top cover 14 has been opened. Top cover 14 can be locked in its closed position by first pushing trigger 66 before rotating the top cover 14 rearwardly into the closed position, or by rapidly rotating top cover 14 downward to thereby force latching mechanism 64 into engagement with the tertiary retainer pin 19.

Additionally, the safing sector assembly 10 of the present invention is designed to facilitate removal of the bolt assemblies 7 from the rotor assembly while the safing sector assembly 10 is secured to the main housing 4. This is in contrast to all currently available minigun safety mechanisms, each of which requires complete removal of the entire safety mechanism, including both the top cover and safing sector components, from the main housing 4 before a bolt assembly 7 can be accessed and removed therefrom. To this end, the safing sector frame 12 includes a channel 70 define in a rear portion thereof. The channel 70 intersects the straight section 55 the elliptical cam track 50. The channel 70 is sized to receive the roller bearing 9 of each bolt assembly 7 therethough. The top cover 14 includes a non-camming portion 72 of the elliptical cam track 50 on an underside of the arm 24. The non-camming portion 72 extends downwardly from the arm 24. Consequently, the non-camming portion rotates with the top cover 14 between the closed position and the open position. As such, when the top cover 14 is in the closed position (see FIG. 4), the non-camming portion 72 blocks or fills the channel 70 and thereby completes the elliptical cam track 50 so that the roller bearings 9, and thus the entirety of each bolt assembly 7, remain captured by the elliptical cam track 50 and follow the non-camming portion 72 of the elliptical cam track 50. When the top cover 14 is in the open position (see FIG. 14), the non-camming portion 72 of the elliptical cam track 50 is removed. This permits the roller bearing 9 of each bolt assembly 7 to be manually slid rearwardly out of the elliptical cam track 50 through the channel 70 so that a given bolt assembly 7 can be detached from the rotor assembly for repair or replacement while the entire safing sector assembly 10 remains secured to the minigun main house 4. No known safing mechanism assembly for an M134 minigun provides this unique functionality, which advantageously eliminates the risk of an operator misplacing essential components while conducting repairs (especially during nighttime operations) and thereby rendering the minigun useless.

As detailed above, the disclosed safing sector assembly 10 of the present invention separates the forward camming portion 56 from the aft camming portion 58 of the elliptical track 50, allowing forward camming portion 56 of elliptical track 50, which is incorporated in safing gate 16, to be removed separately. Safing the machine gun by means of opening safing gate 16 is quick and easy.

The safing sector assembly 10 also separates the top cover 14 from the forward and aft camming portions 56, 58 of the elliptical track 50, allowing the top cover 14 and safing gate 16 to be operated while the safing sector frame 12 containing the aft camming portion 58 of the elliptical cam track 50 responsible for electric barrel rotation remains secured to the machine gun 2. As a result, far less time and risk is required to open the top cover 14 to access the bolt assemblies 7 protected thereby, and transition the minigun back to its armed and ready condition.

For example, in the event it becomes necessary for the operator to both remove unfired cartridges from the minigun 2 and access the bolt assemblies 7, the safing gate 16 can be opened, followed by the top cover 14, and the minigun barrels can be rotated electrically to thereby quickly clear the minigun of live cartridges while the operator visually assesses the bolt assemblies 7 without risk of damaging them or sustaining injury due through accidental discharge. Any damaged or defective bolt assembly 7 can then be quickly and easily removed, repaired, and/or replaced while the safing sector assembly 10 remains secured to the main housing 4. This speeds repairs and thereby returning the weapon to combat readiness without risk of the safing sector assembly 10 becoming misplaced.

In this way, the safing sector assembly 10 of the present invention represents a dramatic improvement over prior art safing mechanisms by providing (i) a primary safety that controls firing of the minigun, (ii) a secondary safety that prevents the gun from being able to fire while the top cover is open, and (iii) a safety mechanism that permits bolt assembly removal while the safety mechanism is secured to the minigun.

Although embodiments of the present invention have been described in detail, it will be understood by those skilled in the art that various modifications can be made therein without departing from the spirit and scope of the invention as set forth in the appended claims. For example, although the M134 minigun is typically chambered for 7.62×51 mm NATO cartridges, it is to be understood that the safing sector assembly of the present invention is functional with miniguns chambered in different calibers, including but not limited to 5.56×45 mm NATO and .338 Norma Magnum, among others.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific apparatus and methods described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention, it is not intended that such references be construed as limitations upon the scope of this invention except as set forth in the following claims.

What is claimed is:

1. A machine gun having a main housing, a rotor assembly supported by the main housing and adapted for being electrically rotated, a plurality of bolt assemblies attached to the rotor assembly, an elliptical cam track extending longitudinally within the main housing for driving the bolt assemblies in forward and rearward directions in response to rotation of the rotor assembly, and a bolt assembly access port defined in the main housing, comprising:

a safing sector frame secured to the main housing of the machine gun, the frame including an aft camming portion of the elliptical cam track on an underside thereof;

a top cover hingedly attached to the frame, the top cover configured to be rotatable between a closed position in which the top cover covers the access port and an open position in which the bolt assemblies are accessible through the access port; and a safing gate hingedly attached to the top cover, the safing gate including a forward camming portion of the elliptical cam track on an underside thereof, the safing gate configured to be rotatable between an armed position in which the bolt assemblies follow the forward camming portion of the elliptical cam track to facilitate firing of the machine gun and a safe position in which the forward camming portion of the elliptical cam track is removed to thereby prevent firing of the machine gun;

wherein the safing gate can only be placed in the armed position while the top cover is in the closed position.

2. The machine gun of claim 1, wherein the top cover can only be placed in the open position while the safing gate is in the safe position.

3. The machine gun of claim 1, wherein the top cover, when rotating to the open position while the safing gate is in the safe position, is configured to carry the safing gate away from the safing sector frame and thereby prevent the safing gate from being rotated to the armed position while the top cover is in the open position.

4. The machine gun of claim 1, wherein the safing gate is configured to prevent the top cover from being rotated to the open position unless the safing gate is in the safe position.

5. The machine gun of claim 1, wherein the safing gate is configured to contact the safing sector frame and thereby prevent the top cover from being rotated out of the closed position while the safing gate is in the armed position.

6. The machine gun of claim 1, wherein the safing gate is configured to rotate within a reference plane containing a longitudinal axis of the machine gun.

7. The machine gun of claim 1, wherein the safing gate rotates in the rearward direction when the safing gate is rotated from the armed position to the safe position.

8. The machine gun of claim 1, wherein the safing gate and top cover are configured to permit rotation of the safing gate from the armed position to the safe position while the top cover is in the closed position.

9. The machine gun of claim 1, wherein:

the safing sector frame includes a first pin by which the top cover is hingedly attached thereto; and the safing gate includes a spring-loaded latch mechanism positioned for engagement with the pin to thereby permit the safing gate to be selectively locked in the armed position and unlocked therefrom.

10. The machine gun of claim 9, wherein the top cover includes:

a second pin by which the safing gate is hingedly attached thereto, and a spring on the second pin configured to urge the safing gate toward the safe position when the safing gate is unlocked from the armed position.

11. The machine gun of claim 10, wherein:

the top cover includes a spring-loaded latch mechanism positioned for engagement with a third pin on the main housing of the machine gun to thereby permit the top cover to be selectively locked in the closed position and unlocked therefrom; and the safing sector frame includes a spring on the first pin configured to urge the top cover toward the open position when the top cover is unlocked from the closed position and the safing gate is unlocked from the armed position.

12. A safing sector assembly for a machine gun having a main housing, a rotor assembly supported by the main housing and adapted for being electrically rotated, a plurality of bolt assemblies attached to the rotor assembly, an elliptical cam track extending longitudinally within the main housing for driving the bolt assemblies in forward and rearward directions in response to rotation of the rotor assembly, and a bolt assembly access port defined in the main housing, the safing sector assembly comprising:

a safing sector frame configured to be secured to the main housing of the machine gun, the frame including an aft camming portion of the elliptical cam track on an underside thereof;

a top cover hingedly attached to the frame, the top cover configured to be rotatable, while the frame is secured to the main housing, between a closed position in which the top cover covers the access port and an open position in which the bolt assemblies are accessible through the access port; and a safing gate hingedly attached to the top cover, the safing gate including a forward camming portion of the elliptical cam track on an underside thereof, the safing gate configured to be rotatable, while the frame is secured to the main housing, between an armed position in which the bolt assemblies follow the forward camming portion of the elliptical cam track to facilitate firing of the machine gun and a safe position in which the forward camming portion of the elliptical cam track is removed to thereby prevent firing of the machine gun;

wherein the safing gate is only rotatable to the armed position while the top cover is in the closed position.

13. The safing sector assembly of claim 12, wherein the top cover is configured to prevent the safing gate from being rotated to the armed position unless the top cover is in the closed position.

14. The safing sector assembly of claim 12, wherein the safing gate is configured to prevent the top cover from being rotated out of the closed position while the safing gate is in the armed position.

15. The safing sector assembly of claim 12, wherein the safing gate is configured to contact the safing sector frame and thereby prevent the top cover from being rotated out of the closed position while the safing gate is in the armed position.

16. The safing sector assembly of claim 12, wherein:

the safing gate is configured to rotate in the rearward direction when moving from the armed position to the safe position; and the top cover is configured to rotate in the forward direction when moving from the closed position to the open position.

17. The safing sector assembly of claim 12, wherein:

the safing sector frame includes:

a first pin by which the top cover is hingedly attached thereto, and a spring configured to urge the top cover toward the open position; and the top cover includes:

a second pin by which the safing gate is hingedly attached thereto, and a spring configured to urge the safing gate toward the safe position.

18. The safing sector assembly of claim 17, wherein:

the safing gate includes a spring-loaded latch mechanism positioned for engagement with the first pin to thereby permit the safing gate to be selectively locked in the armed position and unlocked therefrom; and the top cover includes a spring-loaded latch mechanism positioned for engagement with a third pin on the main housing to thereby permit the top cover to be selectively locked in the closed position and unlocked therefrom.

19. A method of safing a machine gun having a main housing, a rotor assembly supported by the main housing and adapted for being electrically rotated, a plurality of bolt assemblies attached to the rotor assembly, an elliptical cam track extending longitudinally within the main housing for driving the bolt assemblies in forward and rearward directions in response to rotation of the rotor assembly, and a bolt assembly access port defined in the main housing, the method comprising:

securing the safing sector assembly of claim 12 to the main housing of the machine gun over the access port; and rotating the safing gate to the safe position.

20. A safing sector assembly for a machine gun having a main housing, a rotor assembly supported by the main housing and adapted for being electrically rotated, a plurality of bolt assemblies attached to the rotor assembly, an elliptical cam track extending longitudinally within the main housing for driving the bolt assemblies in forward and rearward directions in response to rotation of the rotor assembly, and a bolt assembly access port defined in the main housing, the safing sector assembly comprising:

a safing sector frame configured to be secured to the main housing of the machine gun, the frame including an aft camming portion of the elliptical cam track on an underside thereof;

a top cover hingedly attached to the frame, the top cover configured to be rotatable, while the frame is secured to the main housing, between a closed position in which the top cover covers the access port and an open position in which the bolt assemblies are accessible through the access port; and a safing gate hingedly attached to the top cover, the safing gate including a forward camming portion of the elliptical cam track on an underside thereof, the safing gate configured to be rotatable, while the frame is secured to the main housing, between an armed position in which the bolt assemblies follow the forward camming portion of the elliptical cam track to facilitate firing of the machine gun and a safe position in which the forward camming portion of the elliptical cam track is removed to thereby prevent firing of the machine gun;

wherein the top cover can only be rotated to the open position while the safing gate is in the safe position.

21. A safing sector assembly for a machine gun having a main housing, a rotor assembly supported by the main housing and adapted for being electrically rotated, a plurality of bolt assemblies attached to the rotor assembly, an elliptical cam track extending longitudinally within the main housing for driving the bolt assemblies in forward and rearward directions in response to rotation of the rotor assembly, and a bolt assembly access port defined in the main housing, the safing sector assembly comprising:

a safing sector frame configured to be secured to the main housing of the machine gun, the frame including an aft camming portion of the elliptical cam track on an underside thereof;

a top cover hingedly attached to the frame, the top cover configured to be rotatable, while the frame is secured to the main housing, between a closed position in which the top cover covers the access port and an open position in which the bolt assemblies are accessible through the access port; and a safing gate hingedly attached to the top cover, the safing gate including a forward camming portion of the elliptical cam track on an underside thereof, the safing gate configured to be rotatable, while the frame is secured to the main housing, between an armed position in which the bolt assemblies follow the forward camming portion of the elliptical cam track to facilitate firing of the machine gun and a safe position in which the forward camming portion of the elliptical cam track is removed to thereby prevent firing of the machine gun;

wherein the frame is configured to permit removal of the bolt assemblies from the rotor assembly while the frame is secured to the main housing, the top cover is in the open position, and the safing gate is in the safe position.

22. The safing sector assembly of claim 21, wherein:

the safing sector frame includes a channel defined in a rear portion thereof, the channel intersecting the elliptical cam track; and the top cover includes a non-camming portion of the elliptical cam track on an underside thereof, the non-camming portion configured to rotate with the top cover between the closed position in which the non-camming portion blocks the channel and thereby completes the elliptical cam track, and an open position in which the non-camming portion of the elliptical cam track is removed to thereby permit the bolt assemblies to exit the elliptical cam track through the channel.

23. A machine gun having a main housing, a rotor assembly supported by the main housing and adapted for being electrically rotated, a plurality of bolt assemblies attached to the rotor assembly, an elliptical cam track extending longitudinally within the main housing for driving the bolt assemblies in forward and rearward directions in response to rotation of the rotor assembly, and a bolt assembly access port defined in the main housing, comprising:

a safing sector frame secured to the main housing of the machine gun, the frame including an aft camming portion of the elliptical cam track on an underside thereof;

a top cover hingedly attached to the frame, the top cover configured to be rotatable between a closed position in which the top cover covers the access port and an open position in which the bolt assemblies are accessible through the access port; and a safing gate hingedly attached to the top cover, the safing gate including a forward camming portion of the elliptical cam track on an underside thereof, the safing gate configured to be rotatable between an armed position in which the bolt assemblies follow the forward camming portion of the elliptical cam track to facilitate firing of the machine gun and a safe position in which the forward camming portion of the elliptical cam track is removed to thereby prevent firing of the machine gun;

wherein the main housing includes a pair of retainer pin housings configured to receive and capture a pair of spring-loaded retainer pins, each retainer pin receivable through a portion of the safing sector frame to secure the safing sector frame to the main housing.

* * * * *